US009304484B2

(12) United States Patent
Ogino et al.

(10) Patent No.: US 9,304,484 B2
(45) Date of Patent: Apr. 5, 2016

(54) IMAGE FORMING APPARATUS WITH MOVING LIGHT EXPOSURE UNITS

(71) Applicant: CANON KABUSHIKI KAISHA, Tokyo (JP)

(72) Inventors: Hiroki Ogino, Mishima (JP); Tomonori Matsunaga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/743,165

(22) Filed: Jun. 18, 2015

(65) Prior Publication Data

US 2015/0370219 A1 Dec. 24, 2015

(30) Foreign Application Priority Data

Jun. 20, 2014 (JP) ..... 2014-127490

(51) Int. Cl.
*G03G 21/18* (2006.01)
*G03G 21/16* (2006.01)

(52) U.S. Cl.
CPC ..... *G03G 21/1666* (2013.01); *G03G 21/1633* (2013.01); *G03G 21/1676* (2013.01); *G03G 2221/1684* (2013.01)

(58) Field of Classification Search
CPC ..... G03G 21/1633; G03G 2221/1684
USPC ..... 347/138
See application file for complete search history.

(56) References Cited

U.S. PATENT DOCUMENTS 7,447,467 B2 * 11/2008 Kamimura ..... G03G 15/01 399/119
8,078,085 B2 * 12/2011 Okabe ..... G03G 21/1853 399/118
8,150,294 B2 * 4/2012 Okabe ..... G03G 15/0131 399/110
8,204,404 B2 * 6/2012 Kawai ..... G03G 21/1853 399/107
8,442,415 B2 * 5/2013 Ushiozu ..... G03G 21/1832 399/110
8,583,004 B2 * 11/2013 Kamimura ..... G03G 21/1633 399/110
8,688,000 B2 * 4/2014 Sato ..... G03G 15/0194 399/110
8,725,032 B2 * 5/2014 Sato ..... G03G 21/1633 399/110
8,744,331 B2 * 6/2014 Hasegawa ..... G03G 15/2053 399/329
8,774,673 B2 * 7/2014 Sato ..... G03G 15/0194 399/110
8,953,979 B2 * 2/2015 Mori ..... G03G 21/1633 399/110
9,146,528 B2 * 9/2015 Okabe ..... G03G 21/1633 399/110

FOREIGN PATENT DOCUMENTS

JP 2012-145877 A 8/2012

* cited by examiner

*Primary Examiner* — Clayton E Laballe
*Assistant Examiner* — Leon W Rhodes, Jr.
(74) *Attorney, Agent, or Firm* — Canon USA Inc. IP Division

(57) ABSTRACT

An image forming apparatus that forms an image on a recording medium includes an image-bearing-unit support member, a developing unit support member, a plurality of light exposure units, and a light-exposure-unit operating member. The image-bearing-unit support member is movable between the inside and the outside of the image forming apparatus while supporting a plurality of image bearing units which each include an image bearing member. The developing unit support member is movable independently of the image-bearing-unit support member. The plurality of light exposure units each cause a corresponding one of the image bearing members to be exposed to light so as to form an electrostatic latent image. The light-exposure-unit operating member moves the light exposure units relative to the developing unit support member.

20 Claims, 15 Drawing Sheets

IMAGE FORMING APPARATUS WITH MOVING LIGHT EXPOSURE UNITS

BACKGROUND OF THE INVENTION

1. Field of the Invention

The present invention relates to an image forming apparatus that forms an image on a recording medium in a state where a developing unit is attached.

2. Description of the Related Art

Japanese Patent Laid-Open No. 2012-145877 discloses a structure that allows a developing unit drawer supporting developing cartridges to be moved to the inside and the outside of an apparatus main body of an image forming apparatus. Upward and downward movements of the developing unit drawer are coupled with opening and closing of a front cover of the image forming apparatus. That is, when the front cover is opened, the developing unit drawer is moved upward so as to be separated from a photosensitive drums, thereby allowing the developing unit drawer to be drawn to the outside of the apparatus main body. LED arrays are also provided in the developing unit drawer.

Similarly, Japanese Patent Laid-Open No. 2012-145877 discloses a structure in which upward and downward movements of a photosensitive body drawer supporting photosensitive drums are coupled with the opening and closing of the front cover. When the front cover is opened, the photosensitive body drawer is separated from a conveyance belt, thereby allowing the photosensitive body drawer to be drawn to the outside of the apparatus main body.

According to the related art described in the above-described Japanese Patent Laid-Open No. 2012-145877, the upward and downward movements of the drawers (support members) supporting the developing cartridges and the photosensitive drums are coupled with the opening and closing of a door of the apparatus main body. Thus, a large load is applied when the user opens or closes the door. That is, the load applied when the user operates each of the support members is large.

Accordingly, the present invention provides a structure that reduces a load applied when the user operates a developing unit support member an image-bearing-unit support member.

SUMMARY OF THE INVENTION

According to a representative structure disclosed in the present application, an image forming apparatus that forms an image on a recording medium includes an image-bearing-unit support member, a developing unit support member, a plurality of light exposure units, and a light-exposure-unit operating member. The image-bearing-unit support member is movable between an inside and an outside of the image forming apparatus while supporting a plurality of image bearing units, which each include an image bearing member, such that the image bearing units are removable from the image-bearing-unit support member. The developing unit support member is movable independently of the image-bearing-unit support member between the inside and the outside of the image forming apparatus while supporting a plurality of developing units, which each develop an electrostatic latent image formed on a corresponding one of the image bearing members, such that the developing units are removable from the developing unit support member. The plurality of light exposure units each cause a corresponding one of the image bearing members to be exposed to light so as to form the electrostatic latent image on the image bearing member. The plurality of light exposure units are movably provided in the developing unit support member. The light-exposure-unit operating member moves the light exposure units relative to the developing unit support member when the developing unit support member is inside the image forming apparatus, thereby separating the light exposure units further from the respective image bearing members than respective positions for image formation.

Further features of the present invention will become apparent from the following description of exemplary embodiments with reference to the attached drawings.

DESCRIPTION OF THE EMBODIMENTS

First Embodiment

An embodiment of the present invention will be described in detail below with reference to the drawings.

Figure 1:
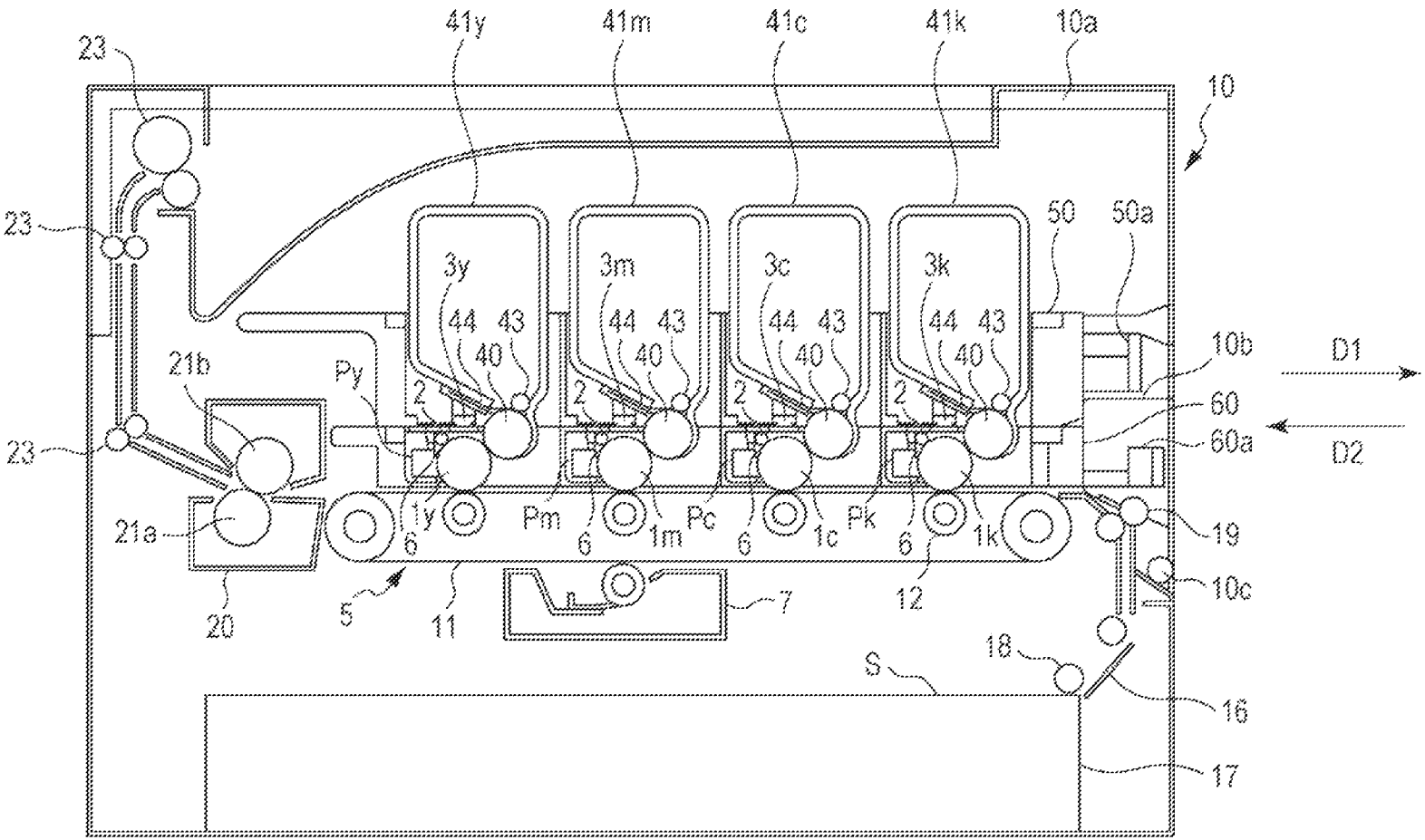
FIG. 1 is a sectional view of an electrophotographic image forming apparatus according to a first embodiment.
Figure 2:
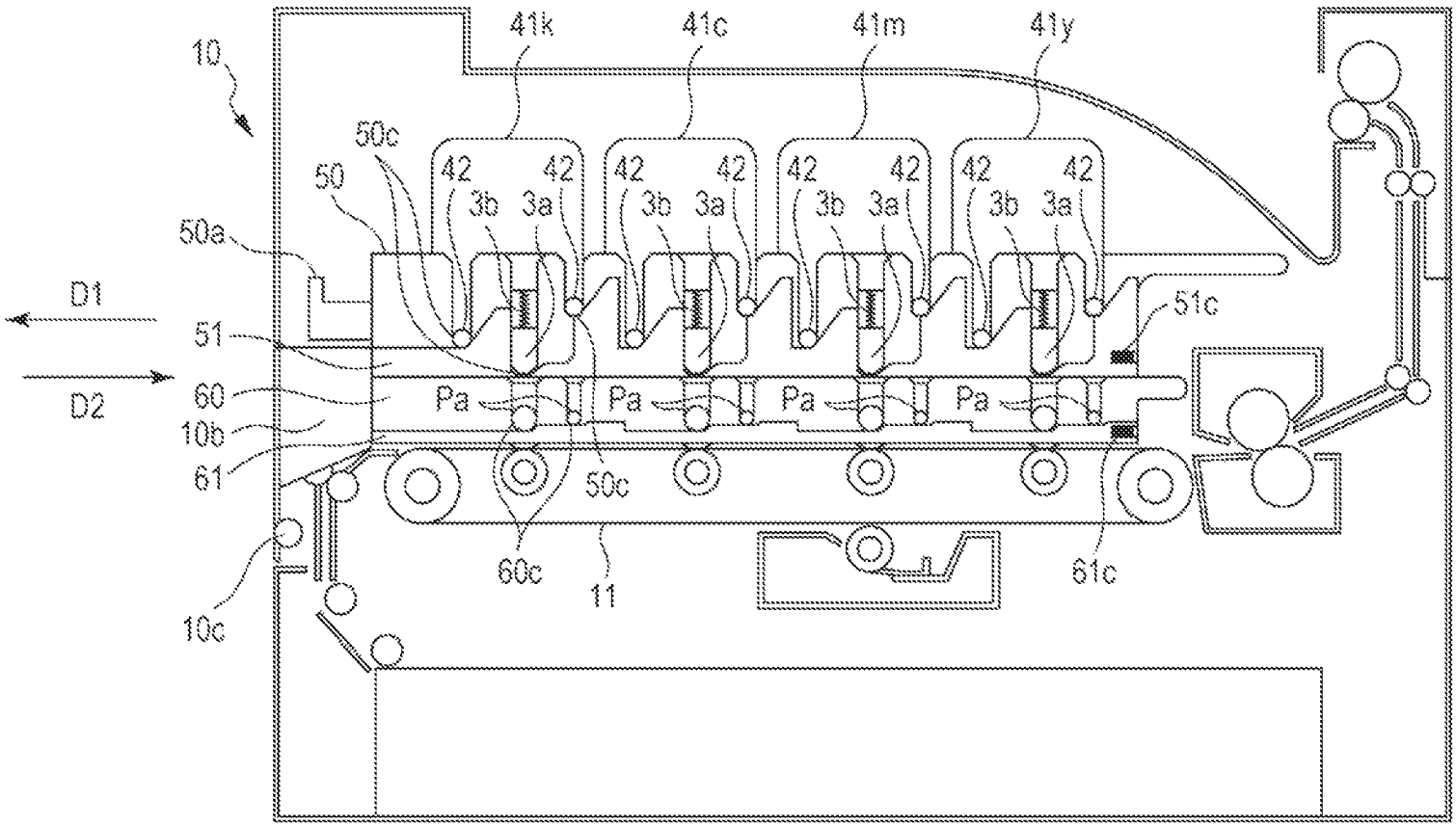
FIG. 2 is a sectional view of the electrophotographic image forming apparatus according to the first embodiment.

Initially, an electrophotographic image forming apparatus according to the present invention is described with reference to FIGS. 1 and 2. FIG. 1 is a sectional view illustrating the electrophotographic image forming apparatus and process cartridges and developing units attached to a drawing member in the electrophotographic image forming apparatus. FIG. 2 illustrates the structure illustrated in FIG. 1 seen in a direction opposite to that of FIG. 1.

Overall Structure

Initially, an overall structure of the image forming apparatus is described with reference to FIG. 1. The image forming apparatus (referred to as an image forming apparatus 100 hereafter) illustrated in FIG. 1 includes four photoelectrically sensitive drums 1 (referred to as "photosensitive drums" hereafter). The photosensitive drums 1 are arranged side-by-side in the horizontal direction.

The photosensitive drums 1 are rotated clockwise in FIG. 1 by a drive device. The following components are arranged around each of the photosensitive drums 1 sequentially in this rotational direction: a charger (charging device) 2 that uniformly charges the surface of the photosensitive drum 1; a light exposure device (light exposure unit) 3 that radiates light in accordance with image information so as to form an electrostatic latent image on the photosensitive drum 1; and a developing unit 41 (41*y*, 41*m*, 41*c*, or 41*k*) that develops the electrostatic latent image with toner serving as developer.

Furthermore, an electrostatic transfer device 5 that transfers toner images (developer images) from the photosensitive drums 1 onto a recording medium S is provided. Cleaning devices 6 are also provided. The cleaning devices 6 remove the toner remaining on the surfaces of the photosensitive drums 1 after the toner images have been transferred.

The developing units 41 (41*y*, 41*m*, 41*c*, and 41*k*) each contain toner (developer) of a corresponding one of colors. The colors are indicated by lower case letters, that is, y for yellow, m for magenta, c for cyan, and k for black. Also in the following description, when a plurality of similar or the same devices (members, units) are each provided for the developer of a corresponding one of different colors, suffixes indicating the colors of the toner y, m, c, and k are added to numerals of devices (members, units) so as to indicate the toner colors to which the devices (members, units) correspond.

A cleaner 7 (cleaning member 7) is provided below an electrostatic transfer belt 11 (referred to as the "transfer belt" hereafter) included in the transfer device 5. The cleaner 7 removes the residual toner attracted to the transfer belt 11.

The photosensitive drums 1 each include, for example, an aluminum cylinder having an outer circumferential surface coated with an organic photoconductive layer (OPC material). Each of the photosensitive drums 1 is rotatably supported by supporting members at both end portions thereof. A drum coupling (not illustrated) that receives a drive force from a drive motor (not illustrated) is disposed at one of the end portions of each of the photosensitive drums 1. Thus, the photosensitive drums 1 are rotated clockwise in FIG. 1. As described above, each of the photosensitive drums 1 serve as an image bearing member that bears the toner image (developer image) on the surface thereof.

The chargers 2 are each of a contact charging type as illustrated in FIG. 1. Charging members are electrically conductive rollers each having a roller shape. These rollers are in contact with the surfaces of the respective photosensitive drums 1. A charging bias voltage is applied to the rollers so as to uniformly charge the surfaces of the photosensitive drums 1.

The light exposure devices (light exposure units) 3 (3*y*, 3*m*, 3*c*, and 3*k*) are disposed above the respective photosensitive drums 1 (1*y*, 1*m*, 1*c*, and 1*k*). The surface of each of the charged photosensitive drums 1 is selectively exposed to an image light beam corresponding to an image signal by using the light exposure devices 3. Thus, the electrostatic latent images in accordance with the image signals are formed.

As illustrated in FIG. 1, the developing units 41 include the developing unit 41*y* that contains the yellow toner, the developing unit 41*m* that contains the magenta toner, the developing unit 41*c* that contains the cyan toner, and the developing unit 41*k* that contains the black toner. The toner in the developing units 41 is fed to toner supply rollers 43.

The toner is applied onto the outer circumferences of developing rollers 40 that each serve as a developing member by the toner supply rollers 43 and developing blades 44 that are in pressure contact with the outer circumferences of the respective developing rollers 40. In addition, charges are applied to the toner. By applying a developing bias to the developing rollers 40, the latent images formed on the photosensitive drums 1 are developed. The developing rollers 40 of the developing units 41 face the respective photosensitive drums 1.

Here, the photosensitive drums 1 are included in respective process cartridges P (Py, Pm, Pc, and Pk). That is, the process cartridges P each serve as an image bearing unit that includes a corresponding one of the photosensitive drums 1 (image bearing member). Each of the process cartridges P includes the charger (charging device) 2 and the light exposure device (light exposure unit) 3, which each serve as a process device (process member) performing operation on the photosensitive drum 1.

As illustrated in FIG. 1, the transfer belt 11 in contact with the photosensitive drums 1 is disposed in the image forming apparatus 100. The transfer belt 11 serves as a belt (belt member) that is rotated in the image forming apparatus 100 and also serves as a conveyance member that conveys the recording medium S. The transfer belt 11 conveys the recording medium S to transfer positions where the toner images on the photosensitive drums 1 are transferred onto the recording medium S.

Four transfer rollers 12 are arranged side-by-side inside the transfer belt 11 so as to face the respective photosensitive drums 1. Positive charges are applied to the recording medium S from these transfer rollers 12 through the transfer belt 11. This causes the toner images on the photosensitive drums 1 to be transferred onto the recording medium S.

The recording medium S is fed and conveyed to an image forming section by a feed unit 16. A plurality of the recording media S are contained in a feed cassette 17. When an image is formed, a feed roller 18 and a registration roller pair 19 are rotated in accordance with image forming operation. Thus, one sheet of the recording media S in the cassette 17 is separated after another and fed. The recording media S are each fed to the transfer belt 11 by the registration roller pair 19 while rotation of the transfer belt 11 and the toner images are synchronized with one another.

A fixing unit 20 fixes the toner images of the plurality of colors having been transferred onto the recording medium S. The fixing unit 20 includes a heating roller 21*a* and a pressure roller 21*b*. The heating roller 21*a* is rotated. The pressure roller 21*b* is in pressure contact with the heating roller 21*a* so as to apply heat and pressure to the recording medium S. That is, the recording medium S onto which the toner images have been transferred from the photosensitive drums 1 passes through the fixing unit 20 while being conveyed by the fixing roller pair 21*a* and 21*b*. The heat and pressure are applied by the fixing roller pair 21*a* and 21*b*. Thus, the toner images of the plurality of colors are fixed onto a side of the recording medium S.

The image forming operation is performed as follows: initially, the photosensitive drums 1 are driven to rotated; Then, the light exposure devices 3 are sequentially driven; When photosensitive drums 1 are driven, the chargers 2 apply uniform charges on circumferential surfaces of the photosensitive drums 1. Then, the light exposure devices 3 radiate light to these circumferential surfaces of the photosensitive drums 1 in accordance with the respective image signals so as to form the electrostatic latent images on the photosensitive drums 1. The developing rollers 40 develop the electrostatic latent images.

As described above, the toner images on the photosensitive drums 1 are sequentially transferred onto the recording medium S by electric fields formed between the photosensitive drums 1 and the transfer rollers 12. The recording medium S onto which the toner images of the four colors have been transferred is conveyed to the fixing unit 20. The toner images are heat fixed onto the recording medium S by the fixing unit 20. After that, the recording medium S is output to the outside of a main body through an output unit 24 by an output roller pair 23.

Description of a Drawing Unit for the Developing Units

Next, a drawing member 50 (developing unit support member) for the developing units 41 is described.

Figure 5:
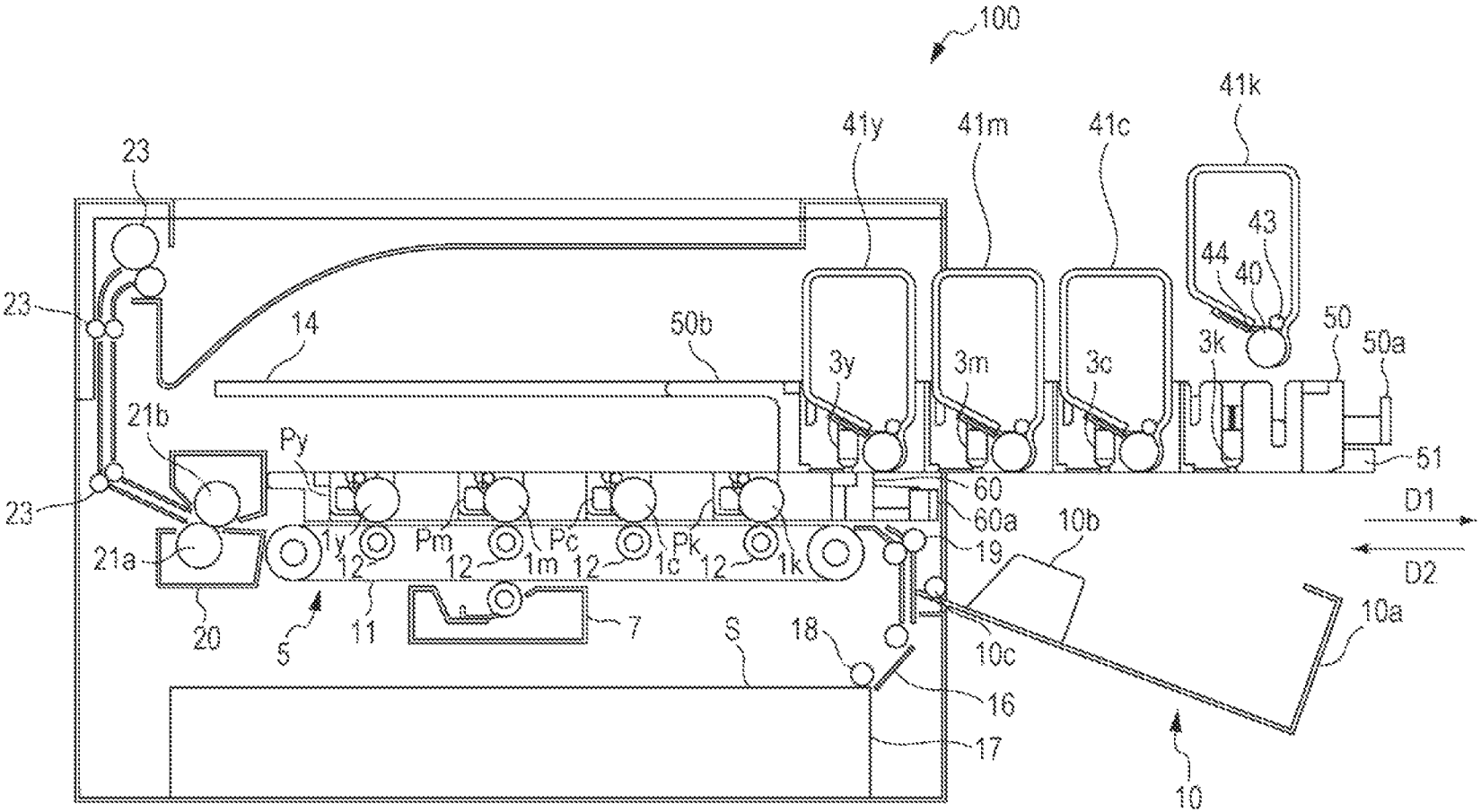
FIG. 5 is a sectional view of the electrophotographic image forming apparatus according to the first embodiment.

Referring to FIG. 5, the light exposure devices 3 (3*y*, 3*m*, 3*c*, and 3*k*) are integrally provided with the drawing member 50 for the developing units so as to allow the light exposure devices 3 and the drawing member 50 to be moved (drawn/pushed) relative to the image forming apparatus 100 in a drawing direction D1 and a inserting direction D2 which are substantially horizontal directions.

The drawing member 50 is the developing unit support member that supports the plurality of developing units 41 such that the developing units 41 are detachable. The drawing member 50 can be positioned at an attached position inside the image forming apparatus 100 illustrated in FIG. 1 and at a drawn position illustrated in FIG. 5 where the drawing member 50 is drawn from the attached position to the outside of the image forming apparatus 100. When the drawing member 50 is at the drawn position, the developing units 41 can be attached to or detached from the drawing member 50.

That is, the developing units 41 are attached to an apparatus main body of the image forming apparatus 100 when the drawing member 50 is moved to the attached position (FIG. 1) after the developing units 41 have been attached to the drawing member 50 positioned at the drawn position (FIG. 5).

By operating the drawing member 50 in reverse order, the developing units 41 can be removed from the apparatus main body of the image forming apparatus 100.

That is, according to the present embodiment, the developing units 41 are cartridges attachable to and detachable from the apparatus main body of the image forming apparatus 100. Here, part of the image forming apparatus 100 other than the developing units 41, the process cartridges P, and the drawing member 50 is particularly referred to as the apparatus main body of the image forming apparatus 100.

Figure 6:
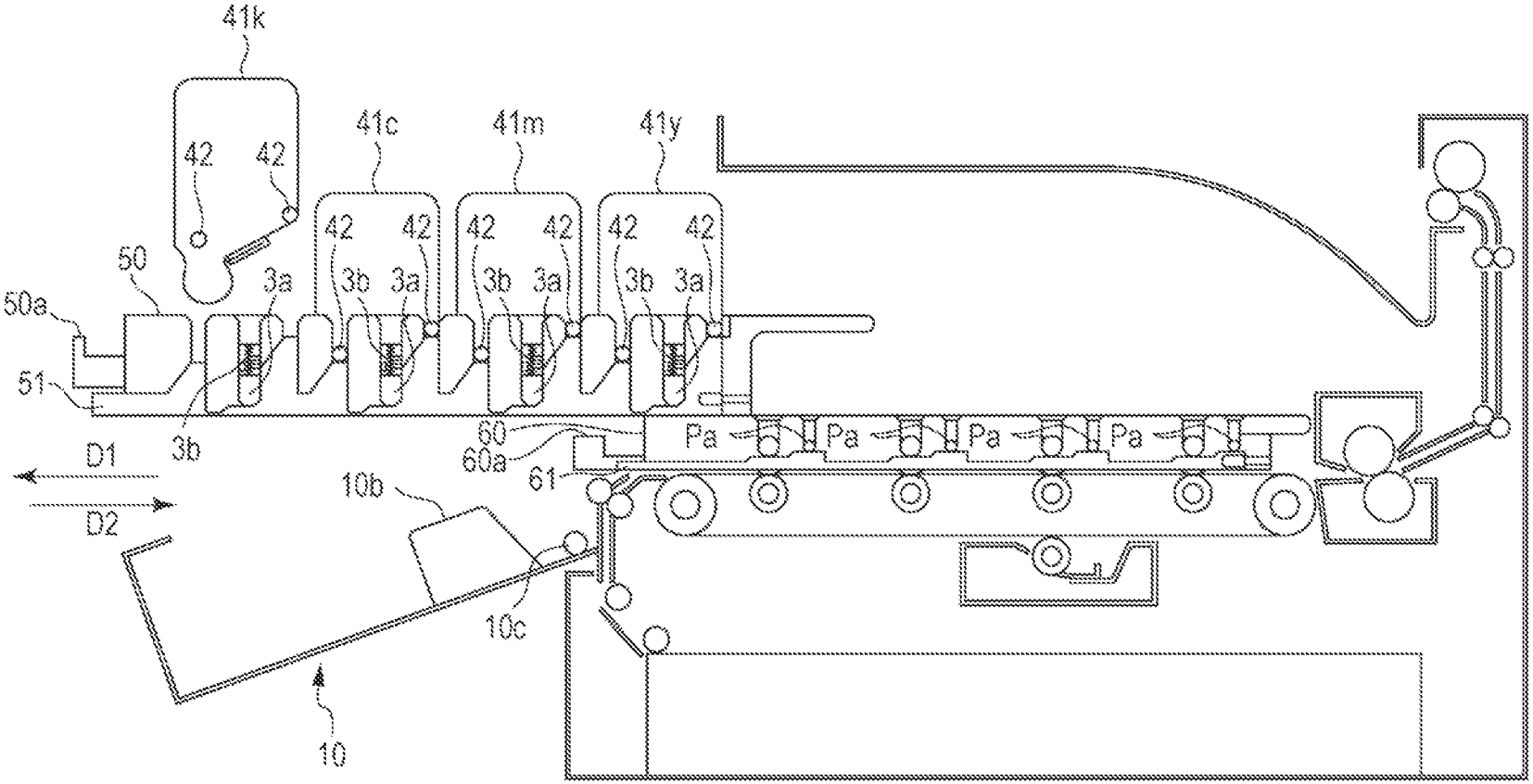
FIG. 6 is a sectional view of the electrophotographic image forming apparatus according to the first embodiment.
Figure 9:
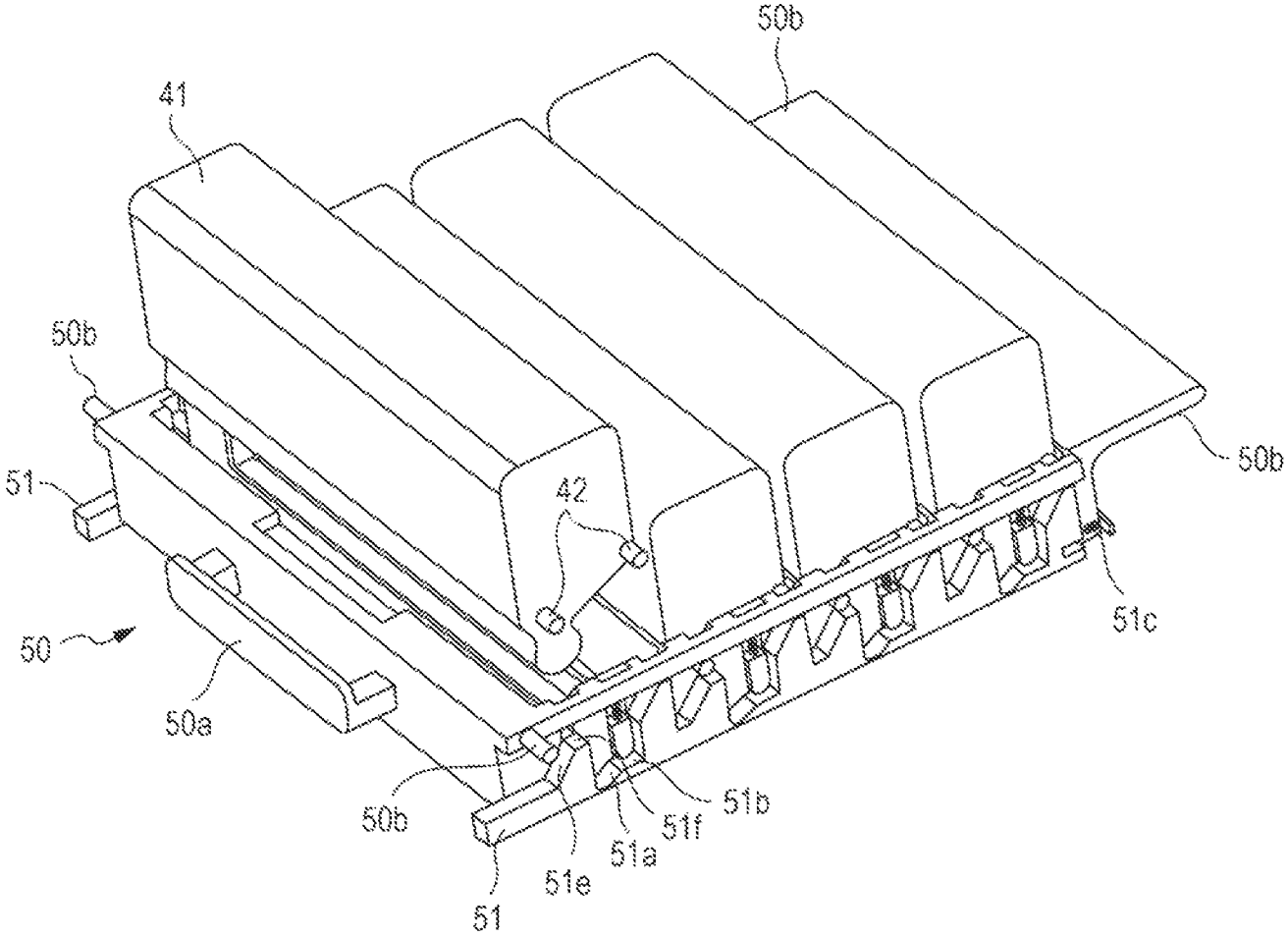
FIG. 9 is a perspective view illustrating a state of developing units attached to a drawing unit according to the first embodiment.

Detailed Description of the Drawing Member for the Developing Units and Developing Unit Separation Member Next, the drawing member 50 is described in detail with reference to FIGS. 1 to 6, 9, and 11. FIG. 5 is a sectional view of the electrophotographic image forming apparatus with the developing units thereof attached to the drawing member for the developing units drawn to the drawn position. FIG. 6 illustrates the structure illustrated in FIG. 5 seen in a direction opposite to that of FIG. 5. FIG. 9 is a perspective view of the drawing member to which the developing units are attached seen from an obliquely upper side.

The drawing member 50 includes portions to be guided 50*b* that are guided by a guide portion 14 of the apparatus main body. One of the portions to be guided 50*b* extends in the inserting direction D2 so as not to allow the drawing member 50 to be inclined at the drawn position. The drawing member 50 also includes a handle 50*a* at one end portion thereof so as to allow the user to operate the drawing member 50.

Furthermore, the light exposure devices (light exposure units) 3 are disposed in the drawing member 50. The light exposure devices 3 include projections 3*a* which are supported such that the projections 3*a* are movable along guides of the drawing member 50. The light exposure devices 3 are urged substantially in the direction of the gravity by urging members 3*b* provided in the drawing member 50.

The drawing member 50 includes a developing unit separation member 51. The developing unit separation member 51 is supported such that the developing unit separation member 51 is horizontally slidable relative to the drawing member 50. When a door (opening and closing member) 10 of the apparatus main body is closed, the developing unit separation member 51 is moved in the inserting direction D2 by a stopper 10*b* provided in the door 10 of the apparatus main body so as to be positioned relative to the drawing member 50 as illustrated in FIGS. 1 and 2.

The door 10 is an opening and closing member that opens and closes an opening through which the drawing member 50 and a drawing member 60 (which will be described in detail later) pass.

In this state, as illustrated in FIG. 2, the projections 3*a* of the light exposure devices 3 and projections 42 of the developing units 41 are brought into contact with positioning portions 50*c* of the drawing member 50, thereby being positioned relative to the photosensitive drums 1.

Figure 3:
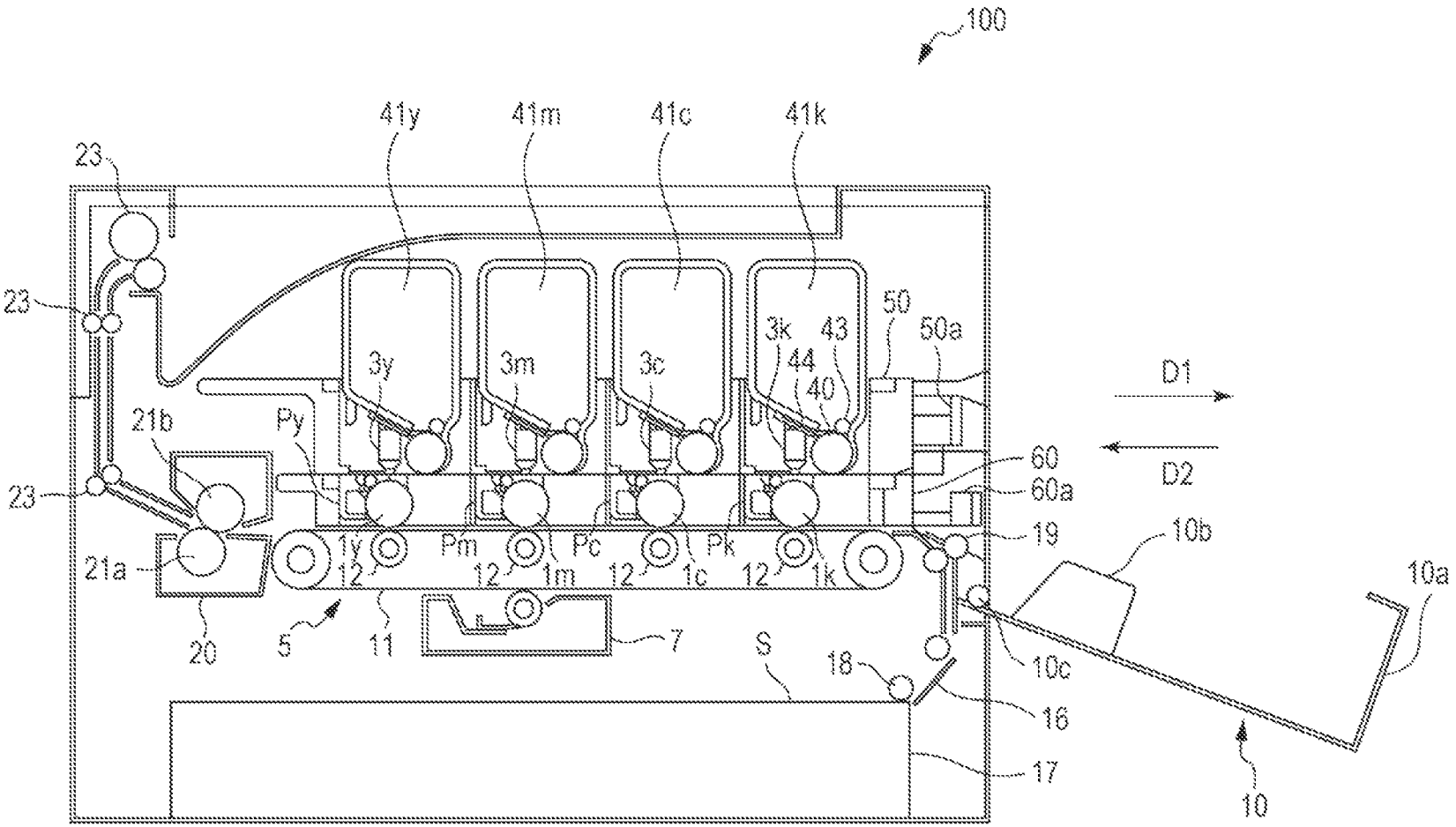
FIG. 3 is a sectional view of the electrophotographic image forming apparatus according to the first embodiment.
Figure 4:
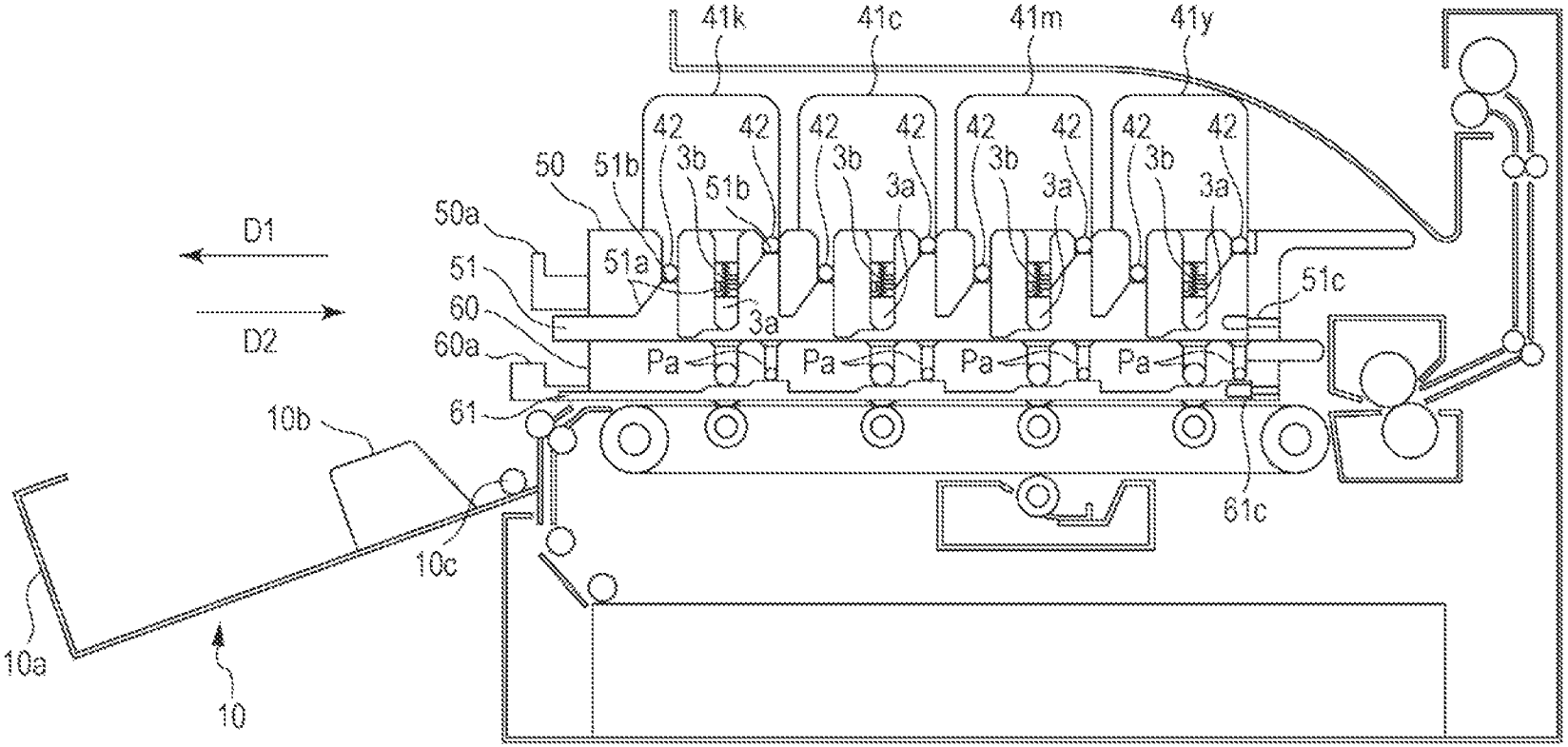
FIG. 4 is a sectional view of the electrophotographic image forming apparatus according to the first embodiment.

Furthermore, when the door 10 of the apparatus main body is opened, the stopper 10*b* provided in the door 10 does not press the developing unit separation member 51. Thus, the developing unit separation member 51 is urged by an urging member 51*c* in the drawing direction D1 so as to be positioned relative to the drawing member 50 as illustrated in FIGS. 3 and 4.

In this state, as the developing unit separation member 51 is slid relative to the drawing member 50, inclined surface portions 51*a* and inclined surface portions 51*e* of the developing unit separation member 51 are smoothly brought into contact with the projections 3*a* of the light exposure devices 3 and the projections 42 of the developing units 41 as illustrated in FIG. 9. This causes the developing unit separation member 51 to press the light exposure devices 3 and the developing units 41 along the inclined surface portions 51*a* and 51*e* upward in the direction of the gravity. The movement of the developing unit separation member 51 relative to the drawing member 50 is completed in a state in which the projections 3*a* of the light exposure devices 3 are in contact with separation portions 51*b* of the developing unit separation member 51 and the projections 42 of the developing units 41 are in contact with separation portions 51*f*.

The inclined surface portions 51*a* that each serve as a movement portion (light-exposure-unit movement portion) are inclined relative to a movement direction in which the developing unit separation member 51 is moved relative to the drawing member 50 and brought into contact with the projections 3*a* of the light exposure devices 3, thereby moving the light exposure devices 3 relative to the drawing member 50. The separation portions 51*b* that each serve as a holding portion (light-exposure-unit holding portion) hold the light exposure units 3 such that the light exposure units 3 are separated from the photosensitive drums 1.

Likewise, the inclined surface portions 51*e* that each serve as a movement portion (developing unit movement portion) are inclined relative to the movement direction in which the developing unit separation member 51 is moved relative to the drawing member 50 and brought into contact with the projections 42 of the developing units 41, thereby moving the developing units 41 relative to the photosensitive drums 1. The separation portions 51*f* that each serve as a holding portion (developing unit holding portion) hold the developing units 41 such that the developing units 41 are separated from the photosensitive drums 1.

The projections 3*a* of the light exposure devices that each serve as a force receiving portion receive forces that move the light exposure devices 3 from the developing unit separation member 51. Likewise, the projections 42 of the developing units 41 that each serve as a force receiving portion receive forces that move the developing units 41 from the developing unit separation member 51.

As described above, by moving the developing unit separation member 51 relative to the drawing member 50 in the drawing direction D1, the light exposure devices 3 and the developing units 41 are moved upward in the direction of the gravity. The developing unit separation member 51 moves the light exposure devices 3 and the developing units sufficiently away from the drawing member 60 (image-bearing-unit support member) that accommodates the process cartridges P. Thus, the drawing member 50 that accommodates the developing units 41 can be drawn. That is, when seen in the drawing direction D1 of the drawing member 50, the drawing member 60 that accommodates the process cartridges P overlaps neither the developing units 41 nor the light exposure devices 3.

Summarization of the above description is as follows. That is, the developing unit separation member 51 that serves as a developing unit operating member moves the developing units 41 relative to the drawing member (developing unit support member) 50. Furthermore, the developing unit separation member 51 that also serves as a light-exposure-unit operating member (that is, the light-exposure-unit operating member also serves as the developing unit operating member) moves the light exposure devices (light exposure units) 3 relative to the drawing member (developing unit support member) 50.

As the door 10 is opened while the drawing member 50 is disposed inside the image forming apparatus 100, the developing unit separation member (light-exposure-unit operating member) 51 moves the light exposure devices 3 and the developing units 41 from positions for image formation in a direction in which the light exposure devices 3 and the developing units 41 are separated from the respective photosensitive drums 1. As the door 10 is closed, the developing unit separation member 51 moves the light exposure devices 3 and the developing units 41 in a direction in which the light exposure devices 3 and the developing units 41 approach the respective photosensitive drums 1 so as to dispose the light exposure devices 3 and the developing units 41 at the positions for the image formation. The door 10 is an operation unit for moving the developing unit separation member 51.

When the door 10 is opened, the light exposure devices 3 and the developing units 41 are separated from the photosensitive drums 1. Thus, the drawing member 50 can be moved into or out of the image forming apparatus 100 without bringing the light exposure devices 3 and the developing units 41 into contact with the photosensitive drums 1. When the door 10 is closed, the light exposure devices 3 and the developing units 41 can be held at positions suitable for the image formation (positions close to the photosensitive drums 1).

Furthermore, the movements of the light exposure devices 3 and the developing units 41 relative to the drawing member 50 are coupled with opening and closing of the door 10. Unlike the related art (Japanese Patent Laid-Open No. 2012-145877), the movement of the drawing member 50 itself is not coupled with the opening and closing of the door 10. It is sufficient that at least the movements of the light exposure devices 3 and the developing units 41 be coupled with the opening and closing of the door 10, and it is not required that the movement of the drawing member 50 be coupled with the opening and closing of the door 10.

That is, when the light exposure devices 3 and the developing units 41 are moved, the drawing member 50 is not moved. This reduces a load for opening or closing the door 10 (load for the operation of the operation unit). Thus, the user can more easily replace the developing unit or the developing units 41 attached to the apparatus main body of the image forming apparatus 100.

Figure 11A:
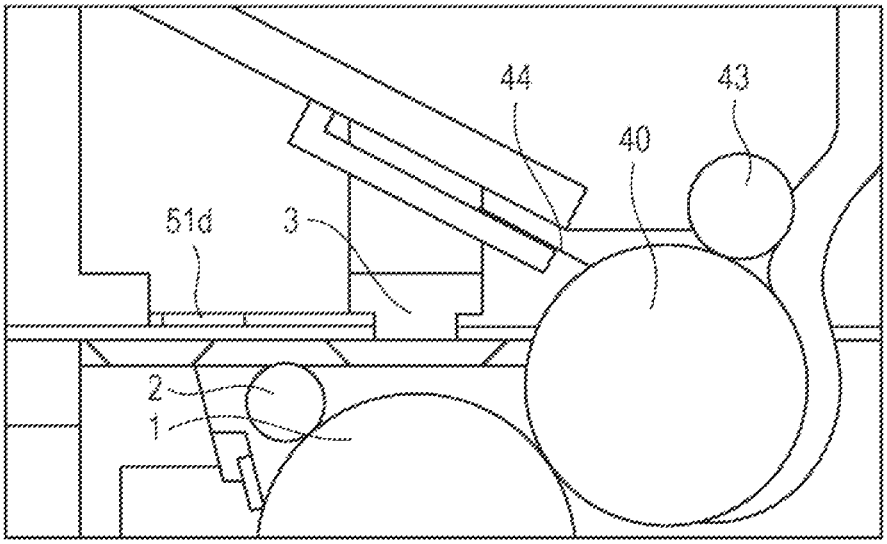
FIGS. 11A and 11B are sectional views of one of light exposure shutters provided in a developing unit separation member according to the first embodiment.
Figure 11B:
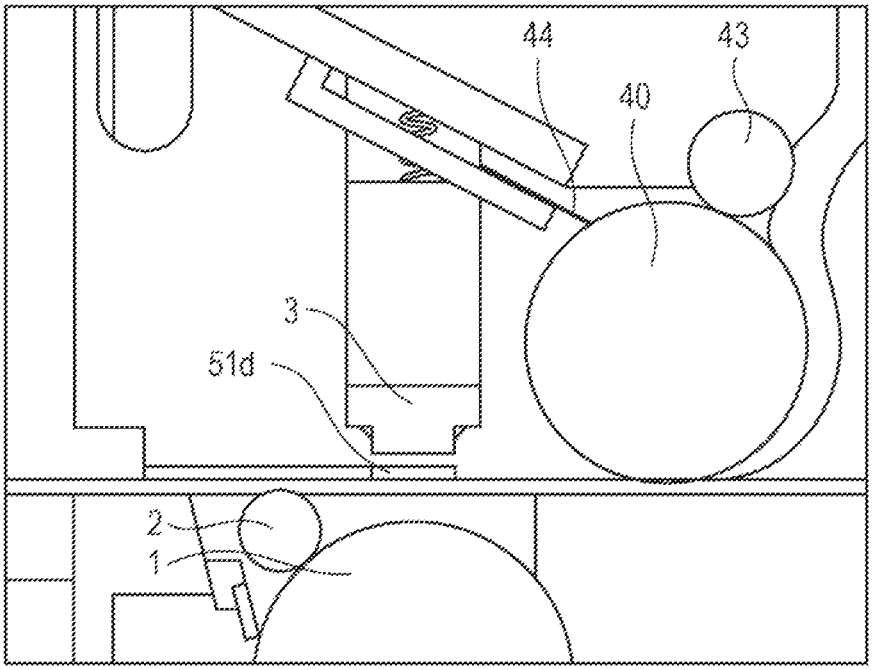

Here, as illustrated in FIGS. 11A and 11B, the developing unit separation member 51 includes light exposure shutters 51*d*. The light exposure shutters 51*d* are each moved from a state illustrated in FIG. 11A to a state illustrated in FIG. 11B as the developing unit separation member 51 is moved. As illustrated in FIG. 11B, the light exposure shutters 51*d* each cover a light exposure portion of a corresponding one of the light exposure devices 3 when the light exposure device 3 is retracted from the drawing member 60 that accommodates the process cartridges P.

Positioning of the Photosensitive Drums and Other Components

According to the present embodiment, an example is described in which the projections 3*a* of the light exposure devices 3 and projections 42 of the developing units 41 are brought into contact with positioning portions 50*c* of the drawing member 50, thereby being positioned relative to the photosensitive drums 1. However, the structure for the positioning is not limited to this. For example, the photosensitive drums 1 and the light exposure devices 3 may be positioned relative to one another by disposing spacers which are provided in the light exposure devices 3 or the photosensitive drums 1 between the light exposure devices 3 and the photosensitive drums 1. Alternatively, the photosensitive drums 1 and the light exposure devices 3 may be positioned relative to one another by bringing contact portions which are provided in frames supporting the photosensitive drums 1 into contact with the respective light exposure devices 3.

The photosensitive drums 1 and the developing units 41 may be positioned relative to one another by disposing spacers which are provided in the photosensitive drums 1 or the developing rollers 40 of the developing units 41 between the photosensitive drums 1 and the developing units 41.

Detailed Description of the Drawing Member for the Process Cartridges and Photosensitive Body Separation Member Next, the drawing member 60 is described in detail with reference to FIGS. 1 to 6, 7, 8, and 10. The drawing member 60 that serves as an image-bearing-unit support member supports the plurality of process cartridges P (image bearing units) such that the process cartridges P are removable from the drawing member 60. The drawing member 60 and the drawing member 50 are independently (separately) movable.

Figure 7:
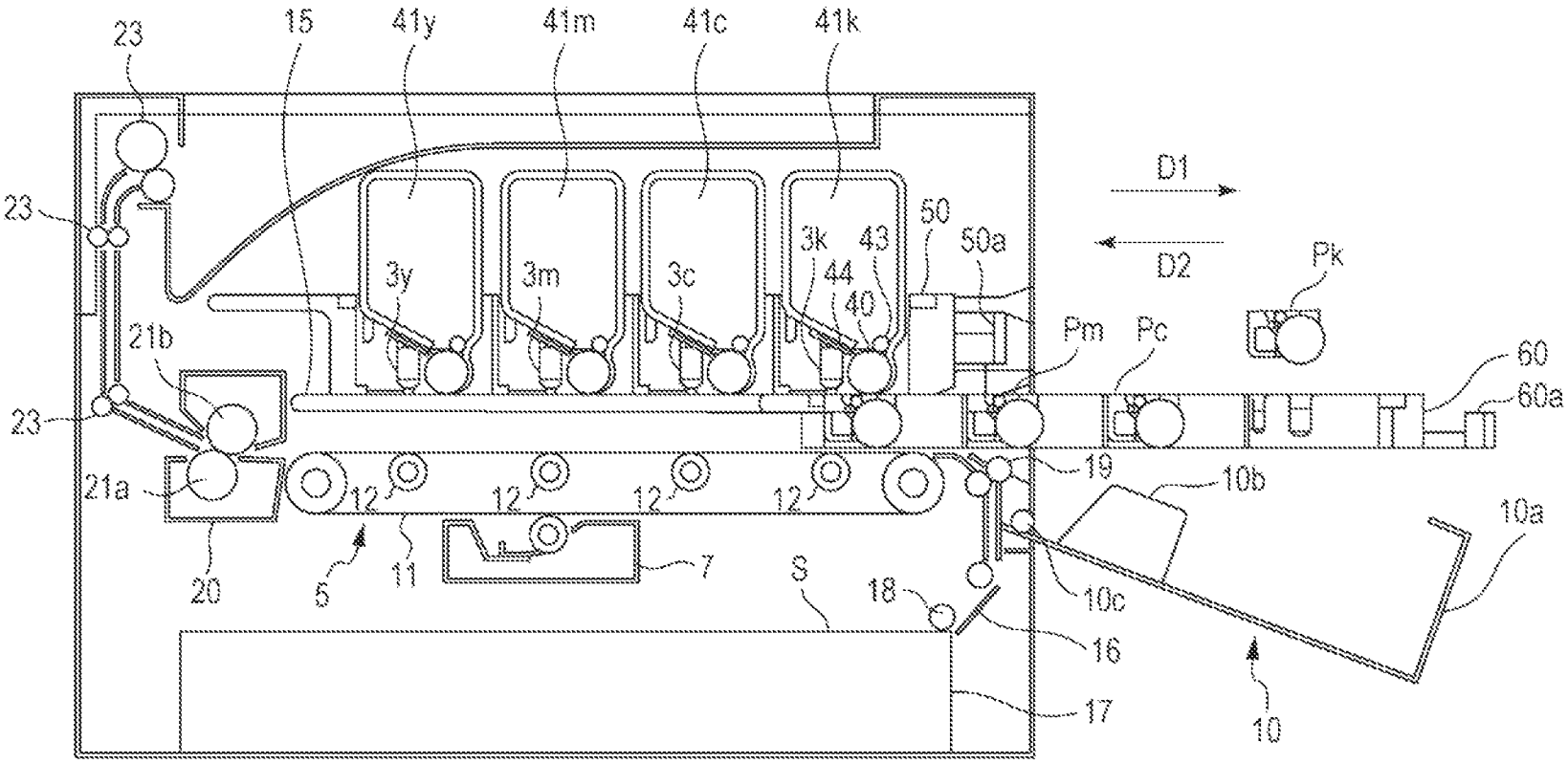
FIG. 7 is a sectional view of the electrophotographic image forming apparatus according to the first embodiment.
Figure 8:
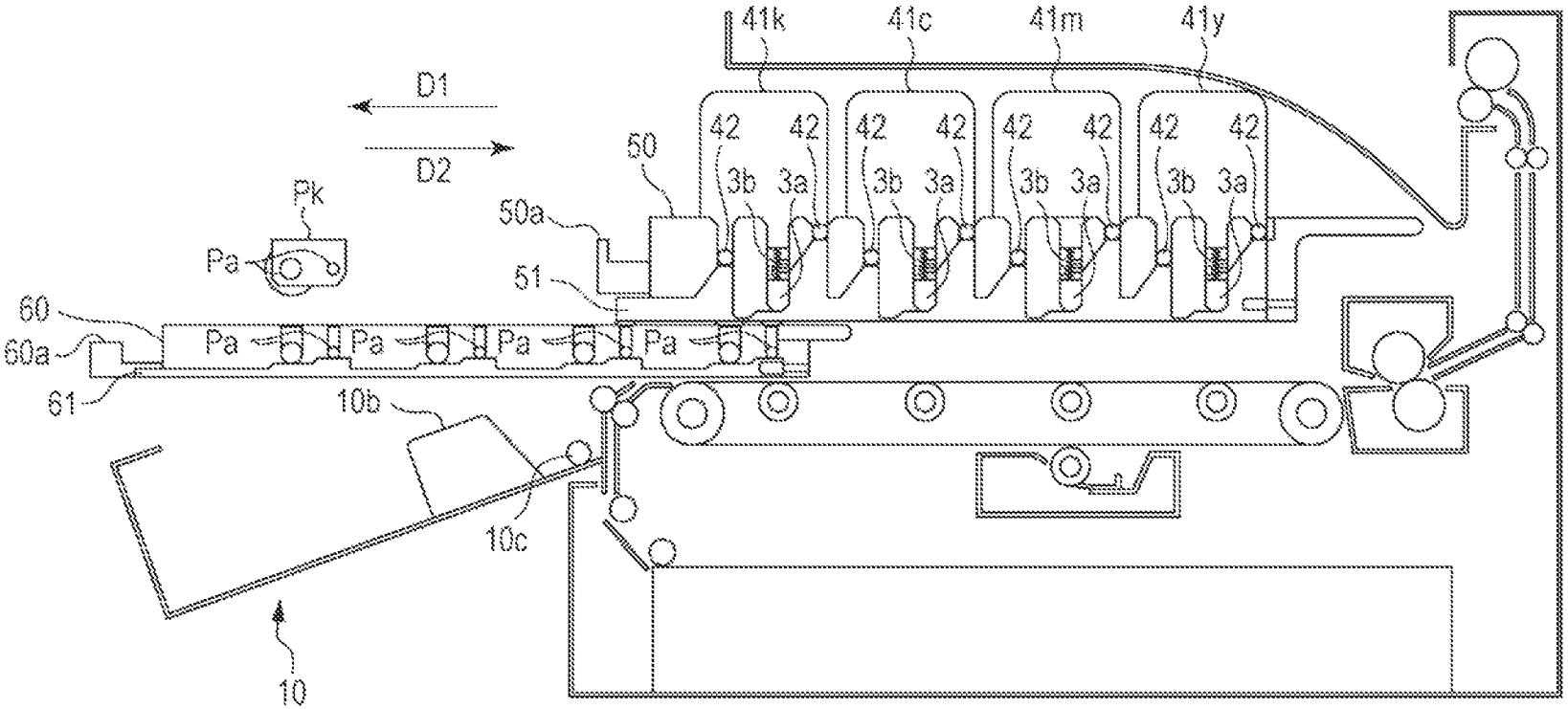
FIG. 8 is a sectional view of the electrophotographic image forming apparatus according to the first embodiment.
Figure 10:
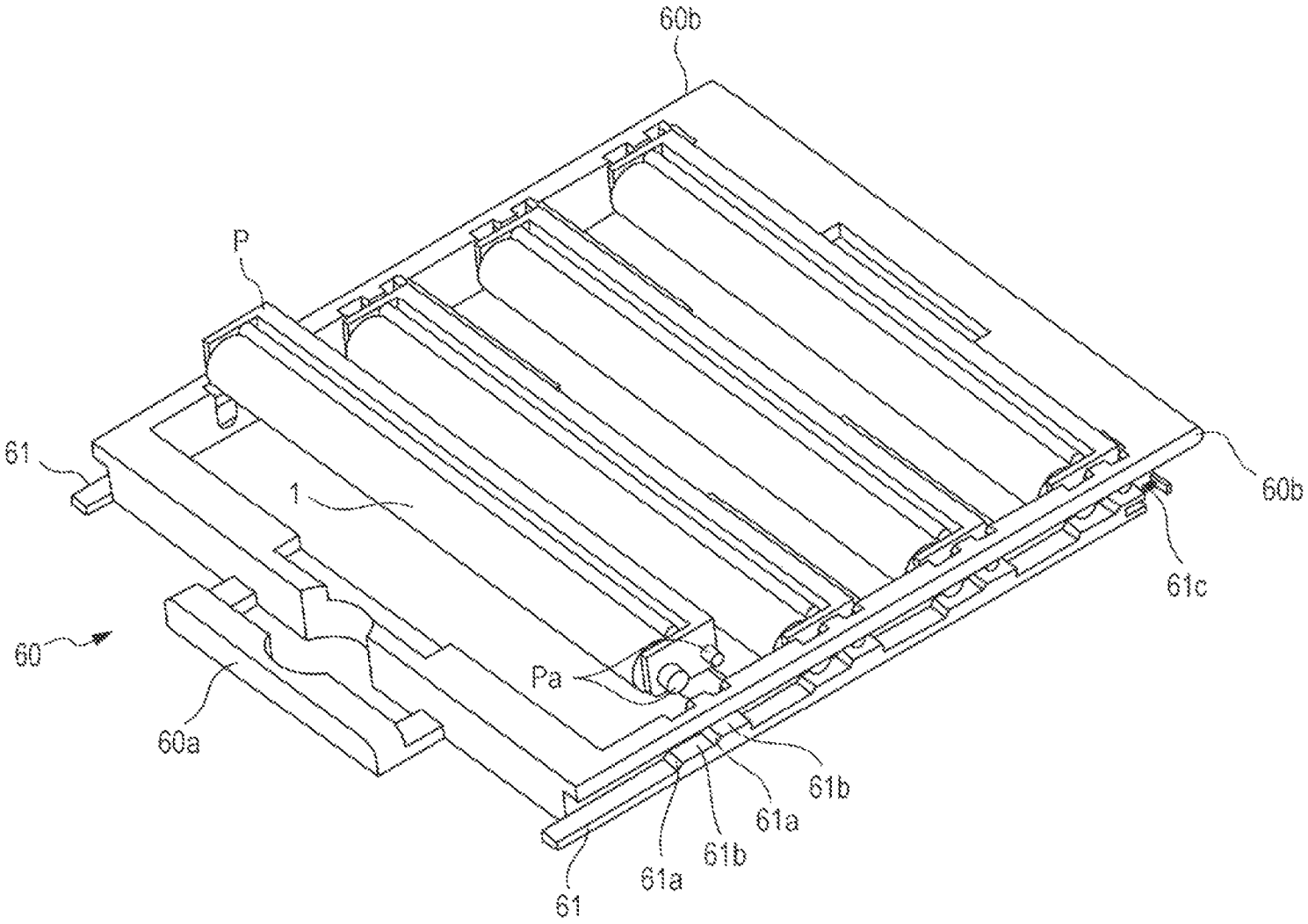
FIG. 10 is a perspective view illustrating states of process cartridges attached to a drawing unit according to the first embodiment.

FIG. 7 is a sectional view of the electrophotographic image forming apparatus with the process cartridges thereof attached to the drawing member for the process cartridges drawn to a drawn position. FIG. 8 illustrates the structure illustrated in FIG. 7 seen in a direction opposite to that of FIG. 7. FIG. 10 is a perspective view of the drawing member 60 to which the process cartridges are attached seen from an obliquely upper side.

The drawing member 60 includes a portion to be guided 60*b* that is guided by a guide portion 15 of the apparatus main body. The portion to be guided 60*b* extends in the inserting direction D2 so as not to allow the drawing member 60 to be inclined at the drawn position. The drawing member 60 also includes a handle 60*a* at one end portion thereof so as to allow the user to operate the drawing member 60.

A photosensitive body separation member (image-bearing-unit operating member) 61 is provided in the drawing member 60 for the process cartridges P. The photosensitive body separation member 61 is supported by the drawing member 60 such that the photosensitive body separation member 61 is horizontally slidable relative to the drawing member 60. When the door 10 of the apparatus main body is closed, the photosensitive body separation member 61 is moved in the inserting direction D2 by the stopper 10*b* provided in the door 10 of the apparatus main body so as to be positioned relative to the drawing member 60 as illustrated in FIGS. 1 and 2.

In this state, as illustrated in FIG. 2, projections Pa of the process cartridges P are brought into contact with positioning portions 60*c* of the drawing member 60, thereby positioning the photosensitive drums 1 relative to the transfer belt 11.

Furthermore, when the door 10 of the apparatus main body is opened, the stopper 10*b* provided in the door 10 does not press the photosensitive body separation member 61. Thus, the photosensitive body separation member 61 is urged by urging member 61*c* in the drawing direction D1 so as to be positioned relative to the drawing member 60 as illustrated in FIGS. 3 and 4.

In this state, as the photosensitive body separation member 61 is slid relative to the drawing member 60, inclined surface portions 61*a* of the photosensitive body separation member 61 are smoothly brought into contact with the projections Pa of the process cartridges P as illustrated in FIG. 10. This causes the photosensitive body separation member 61 to press the process cartridges P along the inclined surface portions 61*a* upward in the direction of the gravity. The movement of the photosensitive body separation member 61 relative to the drawing member 60 is completed in a state in which the projections Pa of the process cartridges P are in contact with separation portions 61*b* of the photosensitive body separation member 61.

The inclined surface portions 61*a* are inclined relative to a movement direction in which the photosensitive body separation member 61 is moved relative to the drawing member 60.

The inclined surface portions 61*a* that each serve as a movement portion (image-bearing-unit movement portion) are brought into contact with the projections Pa of the process cartridges P, thereby moving the process cartridges P relative to the drawing member 60. The separation portions 61*b* that each serve as a holding portion (image-bearing-unit holding portion) hold the process cartridges P such that the process cartridges P are separated from the transfer belt 11.

The projections Pa that each serve as a force receiving portion receive forces that move the process cartridges P from the photosensitive body separation member 61.

As described above, by moving the photosensitive body separation member 61 in the drawing direction D1 relative to the drawing member 60, the process cartridges P are moved upward in the direction of the gravity, and accordingly, the photosensitive drums 1 are moved sufficiently away from the transfer belt 11. Thus, the drawing member 60 that accommodates the process cartridges P can be drawn from the apparatus main body.

Summarization of the above description is as follows. That is, the photosensitive body separation member 61 that serves as the image-bearing-unit operating member moves the process cartridges P (image bearing unit) relative to the drawing member 60 (image-bearing-unit support member).

As the door 10 is opened while the drawing member 60 is disposed inside the image forming apparatus 100, the photosensitive body separation member (image-bearing-unit operating member) 61 moves the process cartridges P from positions for the image formation (image formation positions) in a direction in which the process cartridges P are separated from the transfer belt 11. As the door 10 is closed, the photosensitive body separation member 61 moves the photosensitive drums 1 of the process cartridges P in a direction in which the photosensitive drums 1 approach the transfer belt 11 so as to disposed the photosensitive drums 1 at the positions for the image formation. The door 10 serves as an operation unit for operating the photosensitive body separation member 61.

Accordingly, when the door 10 is opened, the photosensitive drums 1 are separated from the transfer belt 11. Thus, the drawing member 60 can be moved into or out of the image forming apparatus 100 without bringing the photosensitive drums 1 into contact with the transfer belt 11. When the door 10 is closed, the process cartridges P (photosensitive drums 1) can be held at positions suitable for the image formation (positions where the photosensitive drums 1 approach and are brought into contact with the transfer belt 11).

Furthermore, the movements of the process cartridges P relative to the drawing member 60 are coupled with the opening and closing of the door 10. Unlike the related art (Japanese Patent Laid-Open No. 2012-145877), the movement of the drawing member 60 itself is not coupled with the opening and closing of the door 10. It is sufficient that at least the movements of the process cartridges P be coupled with the opening and closing of the door 10. Since the drawing member 60 is not moved, the load for the opening or closing the door 10 is reduced. Thus, the user can more easily replace the process cartridge P or the process cartridges P attached to the apparatus main body of the image forming apparatus 100.

Here, a separating operation of the photosensitive drums 1 from the transfer belt 11 by using the photosensitive body separation member 61 starts at the same time as that of the aforementioned separating operation of the light exposure devices 3 and the developing units 41 from the photosensitive drums 1 or at a delayed time after the aforementioned separating operation of the light exposure devices 3 and the developing units 41 from the photosensitive drums 1 was started. The reason for this is that, as the door 10 is opened about a rotational center 10*c* as a fulcrum, the stopper 10*b* is rotated so as to be separated from the drawing members 50 and 60, and a sliding amount by which the developing unit separation member 51 is slid and a sliding amount by which the photosensitive body separation member 61 is slid are determined depending on the position of the stopper 10*b* of the door 10. At this time, from when the door 10 is started to open to when the door 10 has been opened through a specified rotational angle, the distance between the rotational center 10*c* and the photosensitive body separation member 61 is less than the distance between the rotational center 10*c* and the developing unit separation member 51. Accordingly, the sliding amount of the photosensitive body separation member 61 is less than the sliding amount of the developing unit separation member 51. Thus, the separating operation of the photosensitive drums 1 from the transfer belt 11 by using the photosensitive body separation member 61, the separation operation being coupled with the opening of the door 10, can be performed at the same time as the separating operation of the light exposure devices 3 and the developing units 41 from the photosensitive drums 1 or at a delayed time after the separating operation of light exposure devices 3 and the developing units 41 from the photosensitive drums 1 was started.

This is to prevent the separating operation of the photosensitive drums 1 from the transfer belt 11 from affecting the separation operation of the light exposure devices 3 and the developing units 41 from the photosensitive drums 1. That is, interference of the photosensitive drums 1 with the other components is prevented while the photosensitive drums 1 are being separated from the transfer belt 11.

Furthermore, when both the separating operations are completed, the process cartridges P do not interfere with the drawing member 50 for the developing units 41 and the developing units 41 do not interfere with the apparatus main body.

Attachment and Detachment of the Developing Units and the Process Cartridges from the Drawing of the Developing Units and the Process Cartridges As illustrated in FIGS. 5, 6, and 9, when the drawing member 50 for the developing units 41 is positioned at the drawn position, the developing units 41 (41*y*, 41*m*, 41*c*, and 41*k*) are attached to or detached from the drawing member 50 substantially in the direction of the gravity by the user. In so doing, the developing units 41 (41*y*, 41*m*, 41*c*, and 41*k*) are disposed so as to cover the upper side of the light exposure devices 3 (3*y*, 3*m*, 3*c*, and 3*k*). Thus, toner containers of the developing units 41 are superposed on the light exposure devices 3 in the vertical direction. As a result, a space in the drawing member 50 and a space in the image forming apparatus 100 are sufficiently utilized. Furthermore, toner containing capacity can be ensured.

The developing units 41 are arranged in the movement direction such that the longitudinal direction of the developing units 41 (axial direction of the developing rollers 40) is perpendicular to the movement direction of the drawing member 50.

As illustrated in FIGS. 7, 8, and 10, when the drawing member 60 for the process cartridges P is positioned at the drawn position, the process cartridges P (Py, Pm, Pc, and Pk) are attached to or detached from the drawing member 60 substantially in the direction of the gravity by the user. The process cartridges P can be detached from or attached to the drawing member 60.

The process cartridges P are arranged in the movement direction such that the longitudinal direction of the process cartridges P (axial direction of the photosensitive drums 1) is perpendicular to the movement direction of the drawing member 60.

Attachment of the Drawing Members to the Apparatus Main Body

The developing units 41 (41*y*, 41*m*, 41*c*, and 41*k*) and the process cartridges P (Py, Pm, Pc, and Pk) respectively held by the drawing member 50 and the drawing member 60 are moved into the image forming apparatus 100 together with the respective drawing members 50 and 60.

Furthermore, the developing units 41 and the process cartridges P can be reliably attached to the image forming apparatus 100 when the drawing members 50 and 60 are moved into the image forming apparatus 100 and the door 10 is closed by the user.

Here, the door 10 includes the stopper 10*b*. The closing of the door 10 is coupled with pressing of the developing unit separation member 51 of the drawing member 50 and the photosensitive body separation member 61 of the drawing member 60 by the stopper 10*b*. The developing unit separation member 51 and the photosensitive body separation member 61 are moved in the inserting direction D2 by this pressing by the stopper 10*b*. That is, by using the developing unit separation member 51 and the photosensitive body separation member 61, a separation state in which the light exposure device 3 and the developing units 41 are separated from the photosensitive drums 1 and a separation state in which the photosensitive drums 1 are separated from the transfer belt 11 are canceled, and the light exposure device 3, the developing units 41, and the photosensitive drums 1 are positioned.

At this time, forces by which the separation members 51 and 61 close the door 10 against forces by which the separation members 51 and 61 are urged in the drawing direction D1 applied by the urging members 51*c* and 61*c* are produced. However, a load for closing the door 10 applied by the user is reduced by providing the stopper 10*b* (point of application) near the rotational center 10*c* (fulcrum) of the door 10 and providing the handle 10*a* (point of force) away from the rotational center 10*c*.

As has been described, according to the present embodiment, the structure of a main body device can be simplified compared to a structure with which the movements of drawing members respectively accommodating the developing units and the process cartridges in the up-down direction are coupled with the opening and closing of the door of the main body device. Furthermore, since a load for moving the drawing members accommodating the developing units and the process cartridges in the up-down direction is not applied, the drawing members can be simplified and the load for opening and closing of the door of the main body device applied by the user can be reduced.

Second Embodiment

Another embodiment is described below with reference to FIGS. 12A to 12C. Description of the elements that are the same as or similar to those described in the first embodiment is omitted.

According to the first embodiment, the movements of the plurality of developing units 41 (41*y*, 41*m*, 41*c*, and 41*k*) and the movements of the plurality of light exposure devices 3 (3*y*, 3*m*, 3*c*, and 3*k*) are started at substantially the same time in accordance with the opening or closing of the door 10.

However, when the movements of the plurality of developing units 41 and the movements of the plurality of light exposure devices 3 are started at the same movement start timing, the force for opening or closing the door 10 applied at a time may increase. In this case, it is also conceivable that the movements of the plurality of developing units 41 are started at the movement start timing different from that of the movements of the plurality of light exposure devices 3.

Figure 12A:
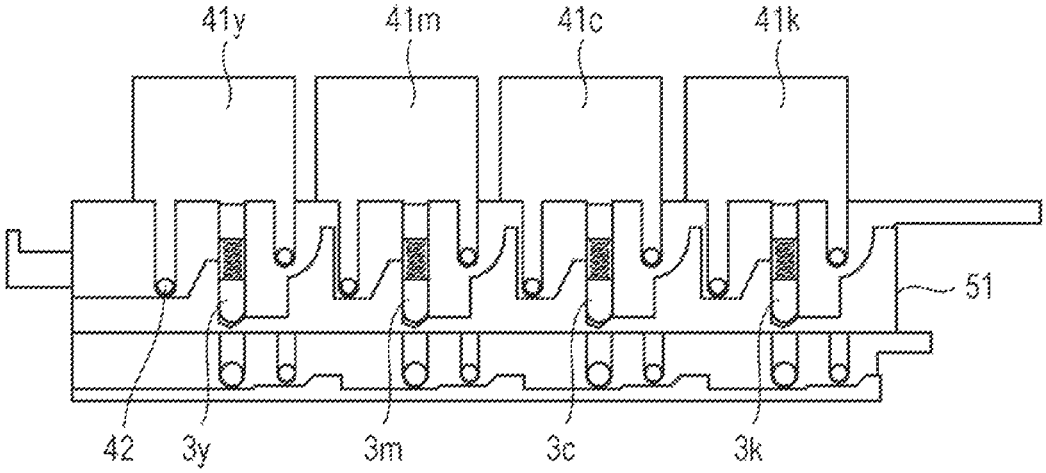
FIGS. 12A to 12C are explanatory views of a second embodiment.
Figure 12B:
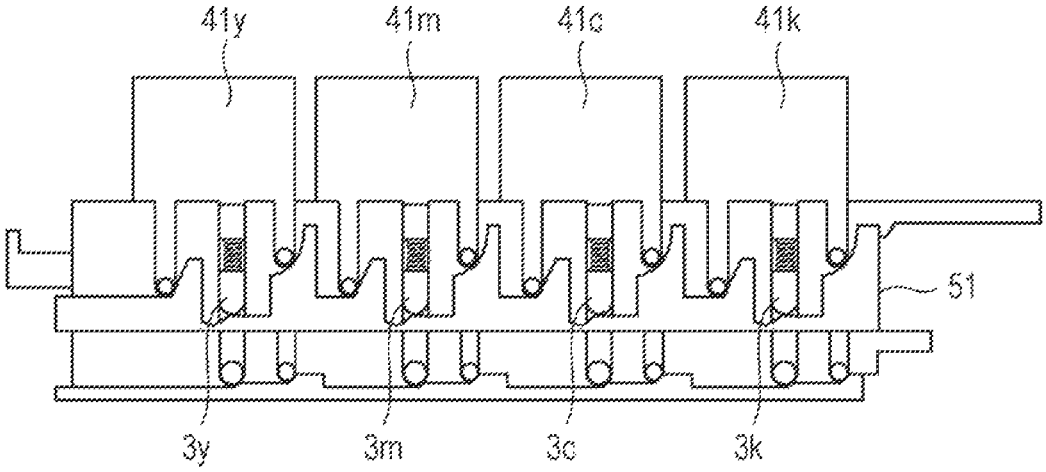
Figure 12C:
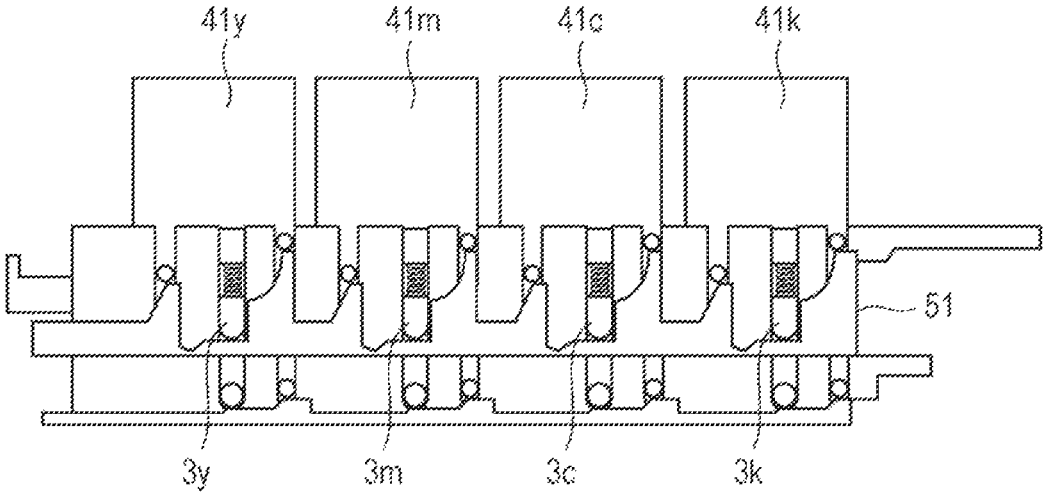

As an example of such a structure, FIGS. 12A to 12C illustrate a structure with which the light exposure devices 3 (3*y*, 3*m*, 3*c*, and 3*k*) are started to move (upward) earlier than the developing units 41 (41*y*, 41*m*, 41*c*, and 41*k*) when the door 10 is opened. That is, when the door 10 is opened, out of the light exposure devices 3 and the developing units 41 performing operation on the same photosensitive drums 1, the developing unit separation member 51 separates the light exposure devices 3 from the photosensitive drums 1 earlier than the developing units 41.

FIG. 12A illustrates a state in which the door 10 is closed and the light exposure devices 3 and the developing units 41 are at positions where the image formation is possible (positions for the image formation). FIG. 12B illustrates a state in which the opening of the door 10 is in the middle, and the developing unit separation member 51 is brought into contact with the projections of the light exposure devices 3, so that the light exposure devices 3 are started to move (upward) so as to be separated from photosensitive drums. When the opening of the door 10 is further continued, the developing unit separation member 51 is brought into contact with the projections 42 of the developing units 41, so that the developing units 41 are started to move (upward) so as to be separated from the photosensitive drums.

With the above-described structure, an effect of suppressing attraction of the toner to the light exposure devices 3 is obtained when the door 10 is opened. The reason for this as follows. That is, the movements of the developing units 41 when the door 10 is opened may lead to a situation in which the developer (toner) borne by the developing rollers of the developing unit 41 flies up and leaves the developing rollers. According to the present embodiment, however, the movements of the light exposure devices 3 are started before the movements of the developing units 41. Thus, when the (upward) movements of the developing units 41 are started, the light exposure devices 3 are separated from the developing units 41. Accordingly, even when the toner flies up and leaves from the developing units 41, this toner is unlikely to be attracted to the light exposure devices 3. In the structure illustrated in FIGS. 12A to 12C, the light exposure devices 3 are moved (downward) before the developing units 41 are moved when the door 10 is closed.

Also, it is conceivable that the light exposure devices 3 are moved before the developing units 41 are moved when the door 10 is closed. In this case, when the door 10 is opened, the developing units 41 are moved before the light exposure devices 3 are moved (the light exposure devices 3 are moved after the developing units 41 have been moved). That is, in the case where the toner is more likely to be attracted to the light exposure devices 3 when the door 10 is closed than when the door 10 is opened, the light exposure devices 3 may be moved before the developing units 41 are moved when the door 10 is closed. Whether the light exposure devices 3 are to be moved before the developing units 41 are moved when the door 10 is opened or when the door 10 is closed is determined depending on the structure of the image forming apparatus 100. One of the methods suitable for the structure may be appropriately selected.

Third Embodiment

When it is only required that forces required to open and close the door 10 be reduced, it is conceivable that the movements of the developing units 41*y*, 41*m*, 41*c*, and 41*k* and the light exposure devices 33*y*, 3*m*, 3*c*, and 3*k* are started at varied movement start timings. An example of such a structure is described with reference to FIGS. 13A to 13C.

Figure 13A:
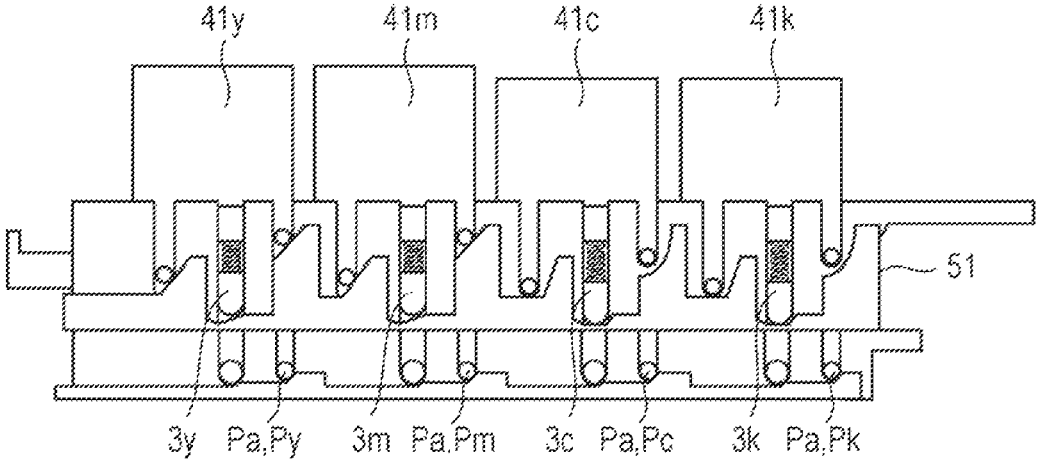
FIGS. 13A to 13C are explanatory views of a third embodiment.
Figure 13B:
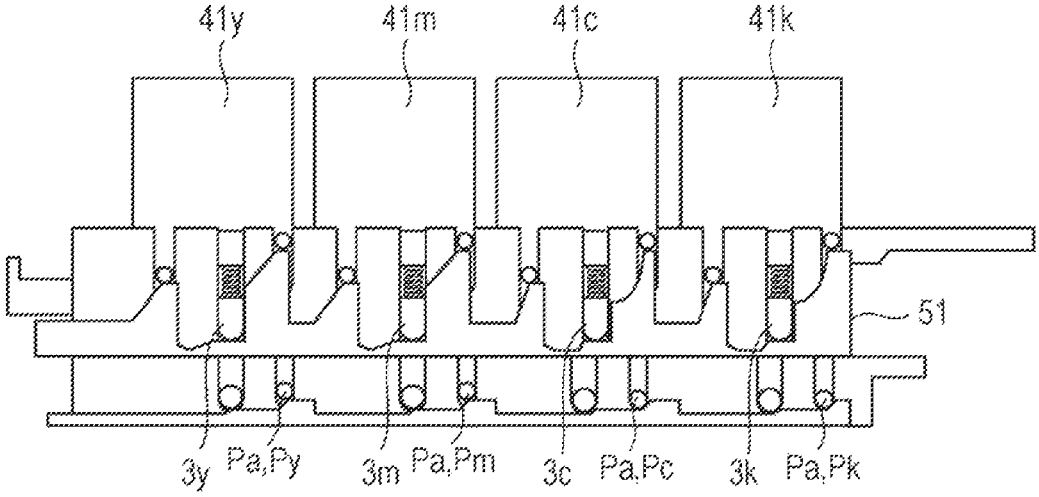
Figure 13C:
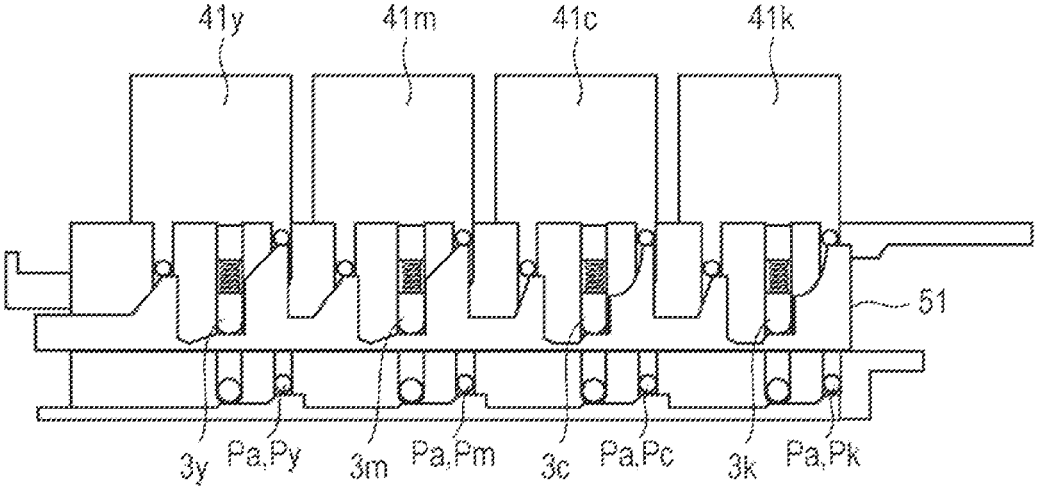

Initially, as illustrated in FIG. 13A, in a process of opening the door 10, the developing units 41*y* and 41*m* and the light exposure devices 3*y* and 3*m* are moved upward first. After that, as illustrated in FIG. 13B, the process cartridges Py and Pm, the developing units 41*c* and 41*k*, and the light exposure devices 3*c* and 3*k* are moved. After that, as illustrated in FIG. 13C, the process cartridges Pc and Pk are moved upward.

According to this third embodiment, the forces applied to open and close the door 10 is further reduced by starting the movements of the process cartridges P Py, Pm, Pc, and Pk at varied movement start timings.

Fourth Embodiment

A fourth embodiment is described with reference to FIGS. 14A and 14B. In the above-described embodiments, the developing unit separation member 51 moves the developing units 41 and the light exposure devices 3 according to the opening or closing of the door 10. According to the present embodiment, however, when the user holds the handle 50*a* provided in the drawing member 50, a lever 50*a*1 provided in the handle 50*a* is moved, and accordingly, the developing unit separation member 51 is moved. That is, not the door 10 but the handle 50*a* serves as the operation unit that moves (operates) the developing unit separation member 51.

Figure 14A:
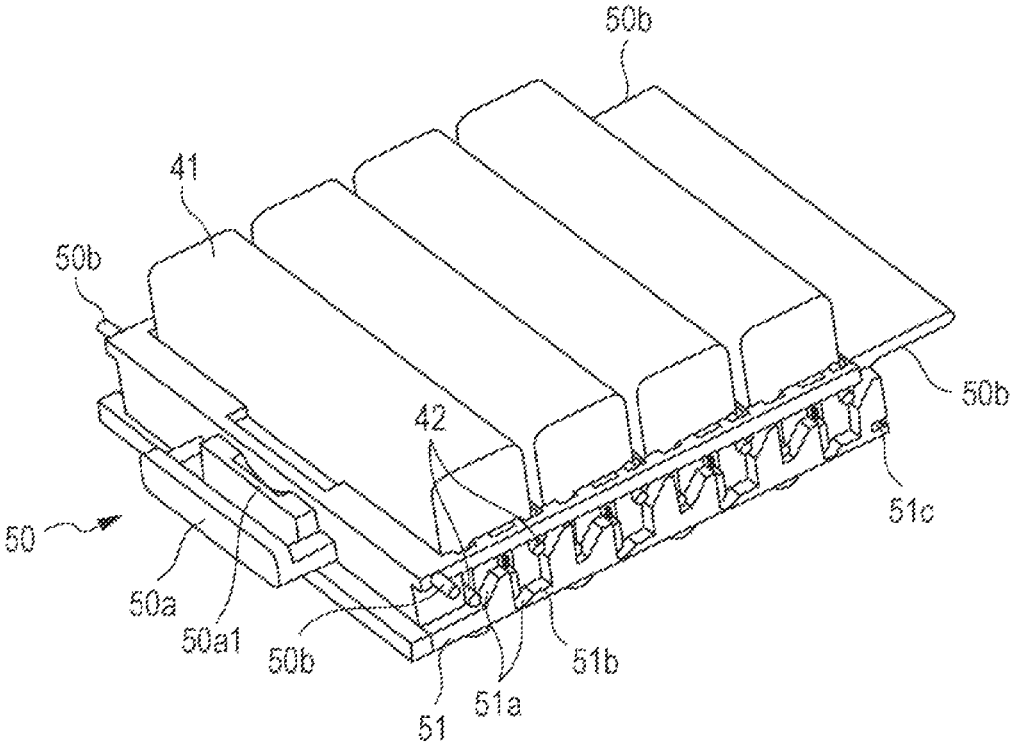
FIGS. 14A and 14B are explanatory views of a fourth embodiment.
Figure 14B:
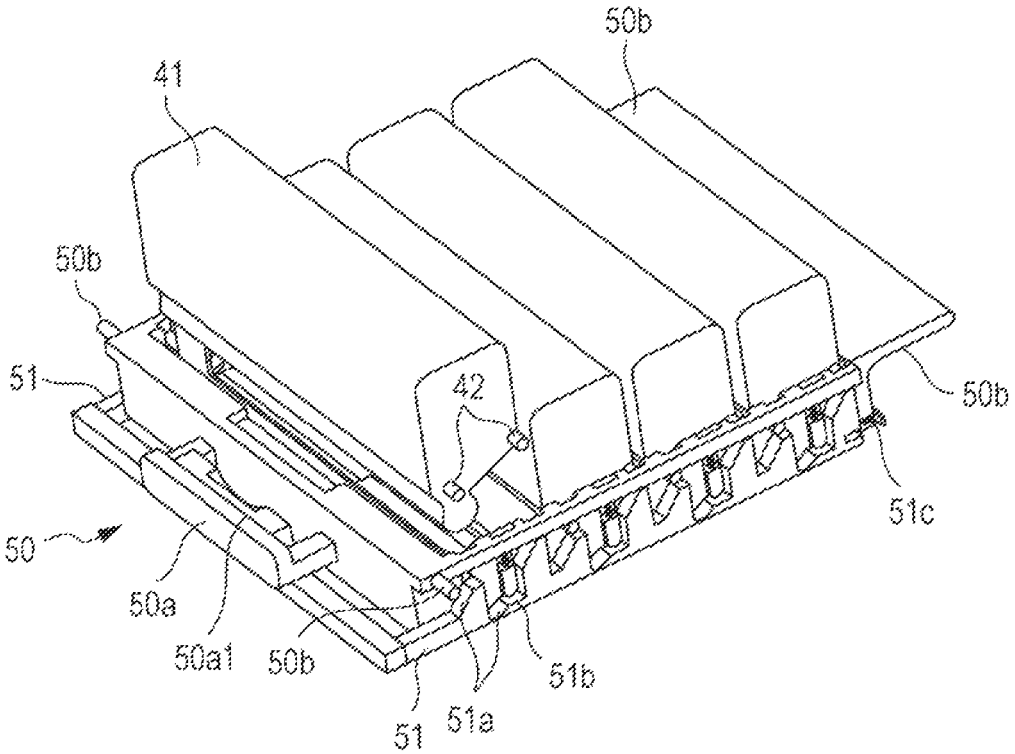

As illustrated in FIGS. 14A and 14B, the lever 50*a*1 is connected to the developing unit separation member 51. FIG. 14A illustrates a state in which the handle 50*a* is not held by the user and FIG. 14B illustrates a state in which the handle 50*a* is held by the user.

As can be understood by comparing FIGS. 14A and 14B, a movement of the lever 50*a*1 relative to the drawing member 50 moves the developing unit separation member 51. This movement of the developing unit separation member 51 moves the developing units 41 and the light exposure devices 3. Referring to FIG. 14B, the developing units 41 and the light exposure devices 3 have been moved in a direction separating from the process cartridges P when the user holds the handle 50*a*.

That is, when the user holds the handle 50*a* while the drawing member 50 is inside the image forming apparatus, the developing units 41 and the light exposure devices 3 are separated from the photosensitive drums 1 of the process cartridges P. In this state, drawing member 50 can be moved from the inside to the outside of the image forming apparatus. In contrast, when the user releases the handle 50*a* to release a held state of the handle 50*a* while the drawing member 50 is positioned inside the image forming apparatus, the developing units 41 and the light exposure devices 3 approach the photosensitive drums 1 of the process cartridges P. In this state, the image formation with the developing units 41 and the light exposure devices 3 is possible.

Figure 15A:
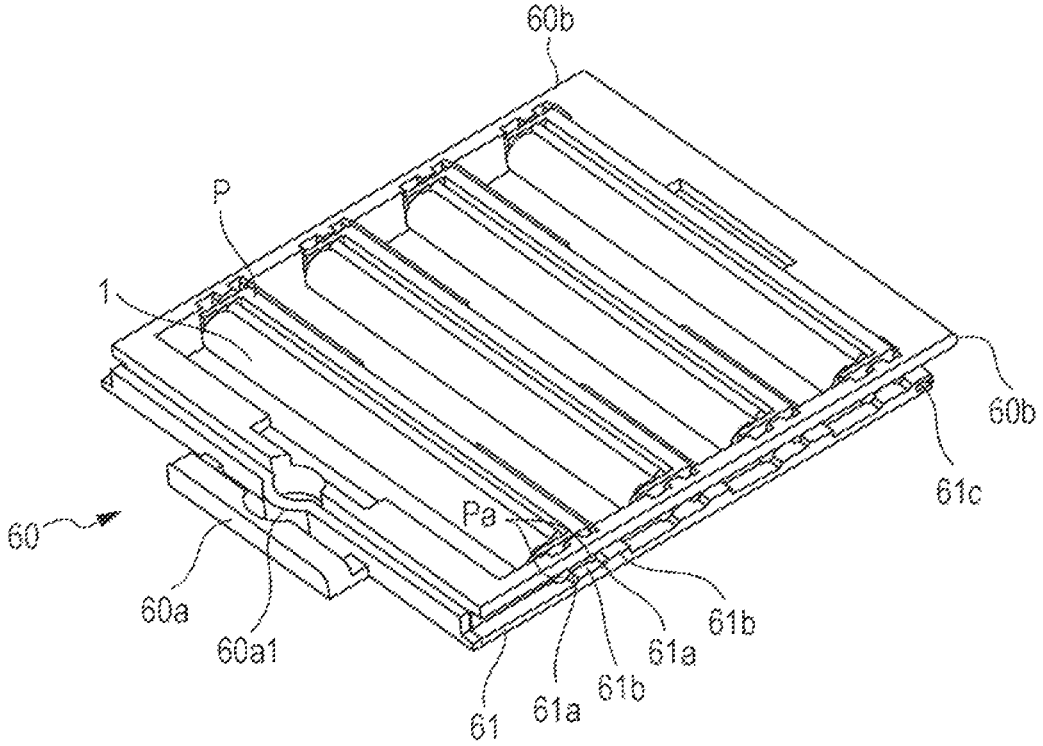
FIGS. 15A and 15B are explanatory views of the fourth embodiment.
Figure 15B:
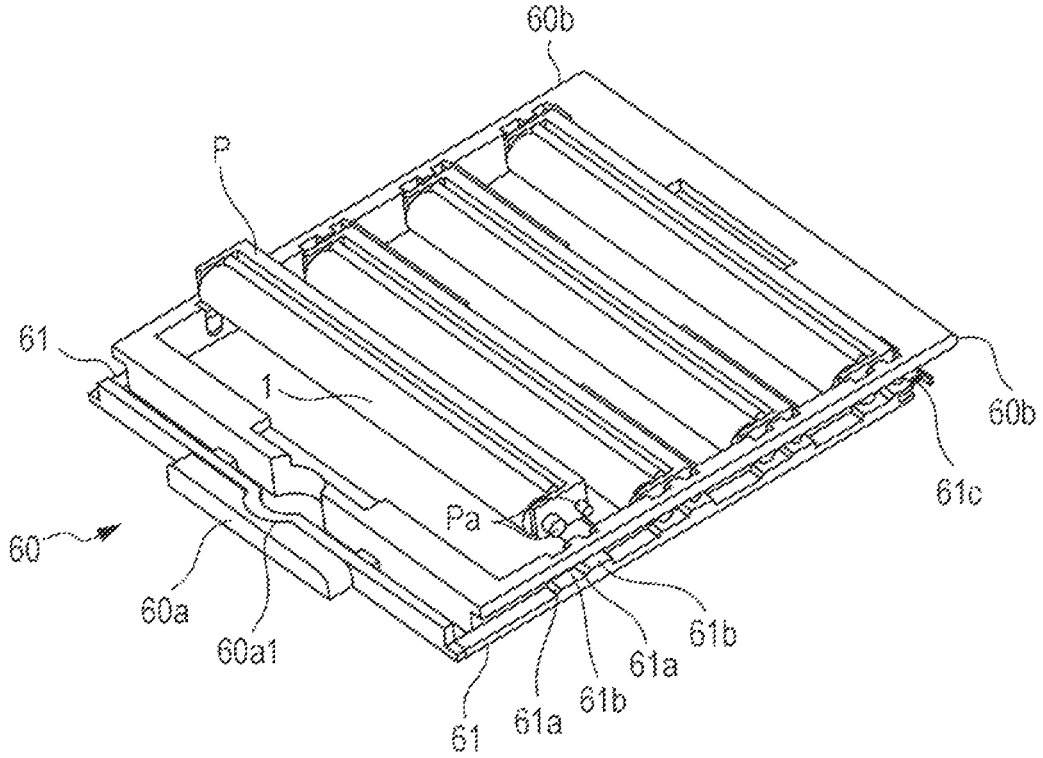

FIGS. 15A and 15B illustrate the structure of the drawing member 60. When the user holds the handle 60*a* provided in the drawing member 60, a lever 60*a*1 provided in the handle 60*a* is moved, and accordingly, the photosensitive body separation member 61 is moved. That is, not the door 10 but the handle 60*a* serves as the operation unit that moves the photosensitive body separation member 61.

As illustrated in FIGS. 15A and 15B, the lever 60*a*1 is connected to the photosensitive body separation member 61. FIG. 15A illustrates a state in which the handle 60*a* is not held by the user and FIG. 15B illustrates a state in which the handle 60*a* is held by the user.

As can be understood by comparing FIGS. 15A and 15B, a movement of the lever 60*a*1 relative to the drawing member 60 moves the photosensitive body separation member 61. This movement of the photosensitive body separation member 61 moves the process cartridges P. Referring to FIG. 15B, the process cartridges P have been moved in a direction separating from the belt when the user holds the handle 60*a*.

That is, when the user holds the handle 60*a* while the drawing member 60 is inside the image forming apparatus, the process cartridges P are separated from the belt. Thus, the drawing member 60 can be moved. In contrast, when the user releases the handle 60*a* to release a held state while the drawing member 60 is positioned inside the image forming apparatus, the process cartridges P approach the belt and the photosensitive drums 1 are brought into contact with the belt. Thus, the image formation is possible.

The handle 50*a* and the handle 60*a* of the present embodiment may be adopted also for the structure described in the second embodiment.

Other Variants

According to the above-described embodiments, the example in which the developing units are drawn from the apparatus main body by using one of the drawing members and the process cartridges P are drawn from the apparatus main body by using the other drawing member is described. However, the present invention is not limited to this. For example, a case where the process cartridges are parts of the apparatus main body and a case where the process cartridges are set to be replaceable without the drawing member are included in the present invention as long as the drawing member for the developing units according to the present invention is used. Likewise, a case where the developing units are parts of the apparatus main body and a case where the developing units are set to be replaceable without the drawing member are included in the present invention as long as the drawing member for the process cartridges according to the present invention is used.

According to the above-described embodiments, the example of the developing units is described. In this case, the toner cartridge that contains the toner and a developing device that accommodates the development roller and so forth are integrally accommodated in each of the developing units. However, the present invention is not limited to this. For example, in the case where the toner cartridges and the developing devices are separately prepared, the toner cartridges may correspond to the developing units of the above-described embodiments and the developing devices may be each integrated with a corresponding one of the process cartridges.

According to the above-described embodiments, the example in which the light exposure devices are integrally provided in the drawing member for the developing units is described. However, the present invention is not limited to this. For example, a case where the light exposure devices are parts of the apparatus main body is included in the present invention as long as the drawing member for the developing units or the drawing member for the process cartridges according to the present invention is used.

According to the above-described embodiments, the transfer belt 11 that conveys the recording medium S serves as the belt member. However, the transfer belt 11 may be an intermediate transfer belt (ITB). That is, the toner images may be directly transferred from the photosensitive drums 1 onto the transfer belt 11 and further transferred from the transfer belt 11 onto the recording medium S.

According to the invention of the present application, a load applied when the user operates a developing unit support member or an image-bearing-unit support member can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-127490, filed Jun. 20, 2014, which is hereby incorporated by reference herein in its entirety.

What is claimed is:

1. An image forming apparatus that forms an image on a recording medium, the apparatus comprising:

an image-bearing-unit support member that is movable between an inside and an outside of the image forming apparatus while supporting a plurality of image bearing units, which each include an image bearing member, such that the image bearing units are removable from the image-bearing-unit support member;

a developing unit support member that is movable independently of the image-bearing-unit support member and that is movable between the inside and the outside of the image forming apparatus while supporting a plurality of developing units, which each develop an electrostatic latent image formed on a corresponding one of the image bearing members, such that the developing units are removable from the developing unit support member;

a plurality of light exposure units that each cause a corresponding one of the image bearing members to be exposed to light so as to form the electrostatic latent image on the image bearing member and that are movably provided in the developing unit support member; and a light-exposure-unit operating member that moves the light exposure units relative to the developing unit support member when the developing unit support member is inside the image forming apparatus, thereby separating the light exposure units further from the respective image bearing members than respective positions for image formation.

2. The image forming apparatus according to claim 1, wherein the light-exposure-unit operating member includes light-exposure-unit holding portions that are brought into contact with the light exposure units, so that the light-exposure-unit holding portions hold the light exposure units so as to be separated from the image bearing members when the developing unit support member is moved.

3. The image forming apparatus according to claim 1, wherein the light-exposure-unit operating member includes light-exposure-unit movement portions that are inclined relative to a movement direction of the developing unit support member and that are brought into contact with the light exposure units, so that the light exposure units are moved in a direction separating from the image bearing members.

4. The image forming apparatus according to claim 1, wherein the light-exposure-unit operating member causes at least one of the plurality of light exposure units to be started to move at different timing from timing at which the light-exposure-unit operating member causes the other light exposure unit or the other light exposure units to be started to move.

5. The image forming apparatus according to claim 1, further comprising:

a developing unit operating member that moves the developing units relative to the developing unit support member when the developing unit support member is inside the image forming apparatus, thereby separating the developing units further from the respective image bearing members than respective positions for image formation.

6. The image forming apparatus according to claim 5, wherein the light-exposure-unit operating member also serves as the developing unit operating member.

7. The image forming apparatus according to claim 5, wherein the developing unit operating member includes developing unit holding portions that are brought into contact with the developing units, so that the developing unit holding portions hold the developing units so as to be separated from the image bearing members when the developing unit support member is moved.

8. The image forming apparatus according to claim 5, wherein the developing unit operating member includes developing unit movement portions that are inclined relative to a movement direction of the developing unit support member and that are brought into contact with the developing units, so that the developing units are moved in a direction separating from the image bearing members.

9. The image forming apparatus according to claim 5, wherein the developing unit operating member causes at least one of the plurality of developing units to be started to move at different timing from timing at which the developing unit operating member causes the other developing unit or the other developing units to be started to move.

10. The image forming apparatus according to claim 5, wherein the light-exposure-unit operating member causes each of the developing units that performs operation on a corresponding one of the image bearing members and a corresponding one of the light exposure units that performs operation on the corresponding one of the image bearing members to be started to move at different timings.

11. The image forming apparatus according to claim 10, wherein, out of the developing unit that performs the operation on the corresponding one of the image bearing members and the corresponding one of light exposure units that performs the operation on the corresponding one of the image bearing members, the light-exposure-unit operating member separates the light exposure unit from the image bearing member before the light-exposure-unit operating member separates the developing unit from the image bearing member.

12. The image forming apparatus according to claim 1, further comprising:

an opening and closing member that opens and closes an opening through which the developing unit support member passes, wherein the light-exposure-unit operating member moves the light exposure units in a direction separating from the respective image bearing members when the opening and closing member is opened, and wherein the light-exposure-unit operating member moves the light exposure units in a direction approaching the respective image bearing members when the opening and closing member is closed.

13. The image forming apparatus according to claim 1, wherein the developing unit support member includes a first handle that is held when the developing unit support member is moved, wherein the light-exposure-unit operating member moves the light exposure units in a direction separating from the respective image bearing members when the first handle is held, and wherein the light-exposure-unit operating member moves the light exposure units in a direction approaching the respective image bearing members when a held state of the first handle is released.

14. The image forming apparatus according to claim 1, further comprising:

a belt member that faces the plurality of image bearing members; and an image-bearing-unit operating member that moves the image bearing units relative to the image-bearing-unit support member when the image-bearing-unit support member is inside the image forming apparatus, thereby separating the image bearing units further from the belt member than respective positions for image formation.

15. The image forming apparatus according to claim 14, wherein, when the image bearing units are moved in a direction separating from the belt member, the image bearing units and the light exposure units are simultaneously started to move or the image bearing units are started to move after the light exposure units have been started to move.

16. The image forming apparatus according to claim 14, wherein the image-bearing-unit operating member includes image-bearing-unit holding portions that are brought into contact with the image bearing units, so that the image bearing units are held so as to be separated from the belt member when the image-bearing-unit support member is moved.

17. The image forming apparatus according to claim 14, wherein the image-bearing-unit operating member includes image-bearing-unit movement portions that are inclined relative to a movement direction of the image-bearing-unit support member and that are brought into contact with the image bearing units, so that the image bearing units are moved in a direction separating from the belt member.

18. The image forming apparatus according to claim 14, further comprising:

an opening and closing member that opens and closes an opening through which the image-bearing-unit support member passes, wherein the image-bearing-unit operating member moves the image bearing units in a direction separating from the belt member when the opening and closing member is opened, and wherein the image-bearing-unit operating member moves the image bearing units in a direction approaching the belt member when the opening and closing member is closed.

19. The image forming apparatus according to claim 14, wherein the image-bearing-unit support member includes a second handle that is held when the image-bearing-unit support member is moved, wherein the image-bearing-unit operating member moves the image bearing units in a direction separating from the belt member when the second handle is held, and wherein the image-bearing-unit operating member moves the image bearing units in a direction approaching the belt member when a held state of the second handle is released.

20. The image forming apparatus according to claim 14, wherein the image-bearing-unit operating member causes at least one of the plurality of image bearing units to be started to move at different timing from timing at which the image-bearing-unit operating member causes the other image bearing unit or the other image bearing units to be started to move.

* * * * *